US011578853B2

(12) United States Patent
Stephens et al.

(10) Patent No.: US 11,578,853 B2
(45) Date of Patent: Feb. 14, 2023

(54) SYSTEMS AND METHODS FOR GENERATING CUSTOMIZABLE MIRRORED EFFECTS WITH INTERCHANGEABLE AND PROGRAMMABLE INFINITY MIRRORS

(71) Applicant: Portal Infinity Mirrors, Inc., Los Angeles, CA (US)

(72) Inventors: Sean Conrad Stephens, Los Angeles, CA (US); John Walter Sanders, Belleville, MI (US)

(73) Assignee: Portal Infinity Mirrors, Inc., Los Angeles, CA (US)

( * ) Notice: Subject to any disclaimer, the term of this patent is extended or adjusted under 35 U.S.C. 154(b) by 0 days.

(21) Appl. No.: 17/748,977

(22) Filed: May 19, 2022

(65) Prior Publication Data

US 2022/0373160 A1 Nov. 24, 2022

Related U.S. Application Data

(60) Provisional application No. 63/190,914, filed on May 20, 2021.

(51) Int. Cl.

| | |
|---|---|
| ***F21V 7/00*** | (2006.01) |
| ***F21V 23/04*** | (2006.01) |
| ***F21V 21/06*** | (2006.01) |
| ***F21V 7/05*** | (2006.01) |
| ***F21V 17/00*** | (2006.01) |
| ***F21Y 113/10*** | (2016.01) |

(52) U.S. Cl.

CPC ..... *F21V 7/0033* (2013.01); *F21V 7/05* (2013.01); *F21V 17/002* (2013.01); *F21V 21/06* (2013.01); *F21V 23/0435* (2013.01); *F21V 23/0471* (2013.01); *F21Y 2113/10* (2016.08)

(58) Field of Classification Search

CPC ..... F21V 7/0033; F21V 7/05; F21V 17/02; F21V 21/06; F21V 23/0435; F21V 23/0471

See application file for complete search history.

(56) References Cited

U.S. PATENT DOCUMENTS

| | | | |
|---|---|---|---|
| 2,114,711 | A | 4/1938 | Hohnstein |
| 2,132,472 | A | 10/1938 | Holm |
| 2,286,247 | A | 6/1942 | Yearta |

(Continued)

*Primary Examiner* — Bryon T Gyllstrom

(74) *Attorney, Agent, or Firm* — Ansari Katiraei LLP; Arman Katiraei; Sadiq Ansari

(57) ABSTRACT

Disclosed is an enhanced infinity mirror with an application interface for controlling and/or changing the illumination, reflection, and/or other effects produced by the enhanced infinity mirror. The enhanced infinity mirror may include a first reflective surface, a second reflective surface positioned relative to the first reflective surface, and light sources that generate an infinity effect based on reflections off the first reflective surface and the second reflective surface. The application interface may receive a pattern, and may control illumination of different sets of the light sources at different times according to the pattern by illuminating a first set of the light sources with first colors for a first duration as defined in a first step of the pattern, and a second set of the light sources with second colors for a second duration as defined in a second step of the pattern.

20 Claims, 15 Drawing Sheets

(56) References Cited

U.S. PATENT DOCUMENTS

| | | | | |
|---|---|---|---|---|
| 4,139,955 | A * | 2/1979 | Reiback | G09F 13/12 359/857 |
| 4,205,521 | A | 6/1980 | Canzanas | |
| 4,761,004 | A | 8/1988 | Hargabus | |
| 5,475,532 | A | 12/1995 | Sandoval et al. | |
| 5,810,465 | A | 9/1998 | Hargabus | |
| 5,951,143 | A | 9/1999 | Ginsburg | |
| 6,709,339 | B1 | 3/2004 | Hargabus | |
| 6,929,552 | B1 | 8/2005 | Hargabus | |
| 9,703,263 | B2 | 7/2017 | Durkee | |
| 9,817,219 | B1 * | 11/2017 | Wu | G02B 17/004 |
| 11,454,374 | B2 * | 9/2022 | Lim | F21V 14/08 |
| 2010/0270933 | A1 * | 10/2010 | Chemel | H05B 47/155 315/130 |
| 2015/0252984 | A1 * | 9/2015 | Van Bommel | F21V 9/32 362/84 |
| 2016/0061396 | A1 * | 3/2016 | Bosua | F21K 9/238 362/231 |
| 2017/0163439 | A1 * | 6/2017 | Bosua | H04W 76/11 |
| 2017/0175987 | A1 * | 6/2017 | Newton | F21V 23/0464 |
| 2021/0199280 | A1 * | 7/2021 | Cho | G02B 6/0075 |

* cited by examiner

Configure the enhanced infinity mirror in real-time to illuminate with a first pattern that creates a first infinity effect associated with a new email notification Configure the enhanced infinity mirror in real-time to illuminate with a second pattern that creates a second infinity effect associated with a text message notification

SYSTEMS AND METHODS FOR GENERATING CUSTOMIZABLE MIRRORED EFFECTS WITH INTERCHANGEABLE AND PROGRAMMABLE INFINITY MIRRORS

CLAIM OF BENEFIT TO RELATED APPLICATIONS

This application claims the benefit of U.S. provisional application 63/190,914 entitled "Interchangeable Infinity Mirrors with Synchronized and Customizable Illumination", filed on May 20, 2021. The contents of application 63/190,914 are hereby incorporated by reference.

BACKGROUND

An infinity mirror positions two or more mirrors or reflective surfaces relative to one another to create an illusion of depth with smaller and smaller reflections that appear to pass through the back of the mirror. The infinity mirror and the static effect that it produces may serve as the foundation for various other lighting, reflection, and/or other effects.

DETAILED DESCRIPTION OF PREFERRED EMBODIMENTS

The following detailed description refers to the accompanying drawings. The same reference numbers in different drawings may identify the same or similar elements.

Provided are systems and methods for generating customizable mirrored effects with interchangeable and programmable infinity mirrors. The systems and methods may include an enhanced infinity mirror with an onboard interface or a wireless interface that allows a user to control and/or change the illumination, reflection, and/or other effects produced by the enhanced infinity mirror. The enhanced infinity mirror may synchronize with other enhanced infinity mirrors via the wireless interface, and/or may include sensors for receiving and adapting to input that is not provided by the user. Accordingly, the enhanced infinity mirror may generate customizable illumination patterns, may generate synchronized lighting effects and/or visual experiences that span multiple mirrors and/or that automatically adapt to changes in environmental lighting, sound, vibrations, temperature, motion, location, position, orientation, and/or other sensory input, and/or may generate lighting effects to facilitate communication or interaction between different remote users. The enhanced infinity mirror may include interchangeable parts for customizing the outward presentation of the mirror, and for adapting the mirror from a tabletop device to a wearable device (e.g., eyewear, watches, headwear, etc.), jewelry, furniture, handheld device, accessories that may be attached to clothing, bags, walls, cars, and/or other objects, and/or devices for other applications or form factors.

The enhanced infinity mirror provides a level of customization that has heretofore not been available. Specifically, the enhanced infinity mirror may support customizable lighting effects via the onboard interface or via an application that wirelessly controls the coloring, brightness, patterns, sequencing, and/or other illumination of individual lights of the enhanced infinity mirror, and may support a physical customization of the size, shape, attachments, components, and/or form factor of the enhanced infinity mirror.

Figure 1:
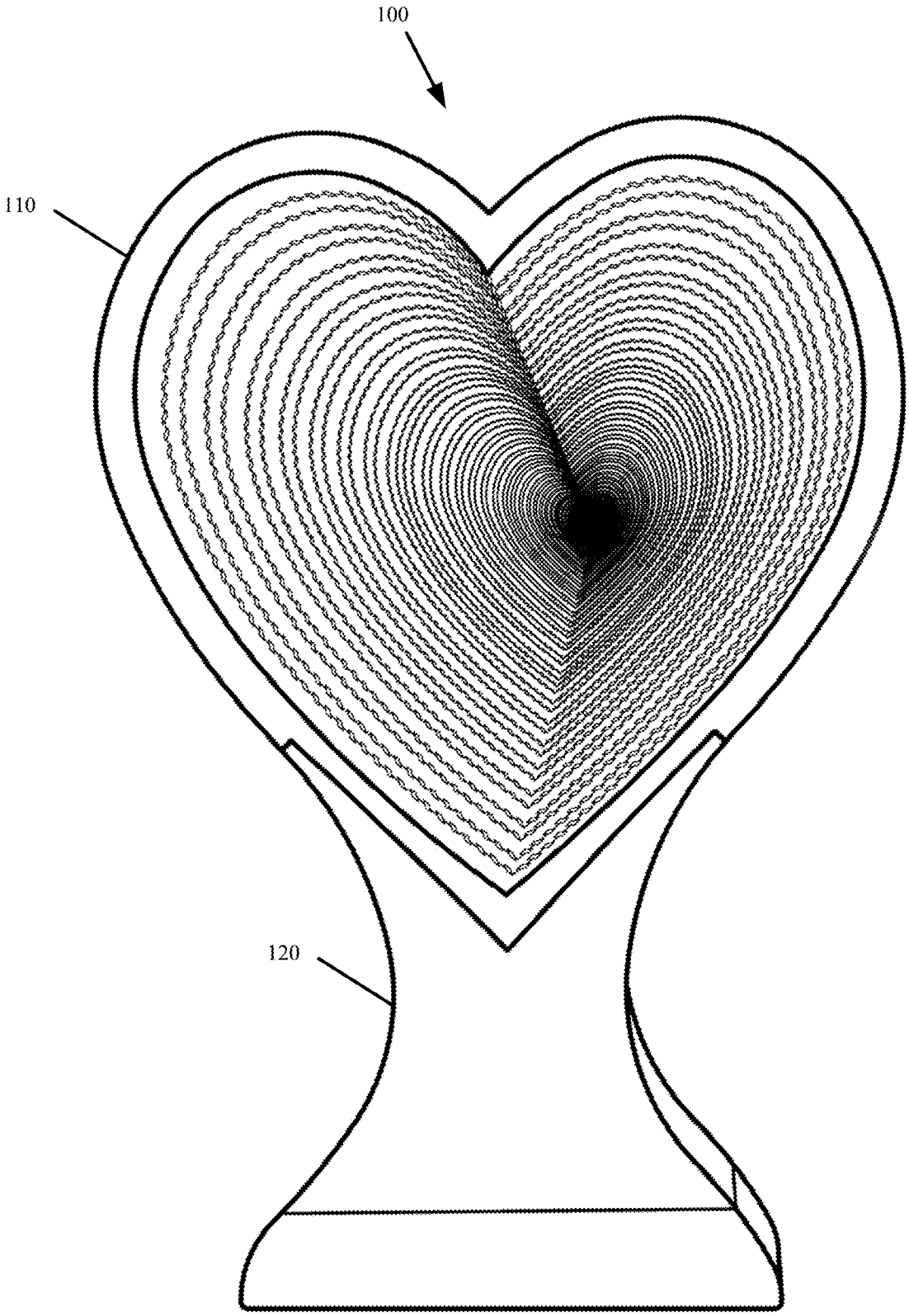
FIG. 1 illustrates a front view of an enhanced infinity mirror in accordance with some embodiments presented herein.

FIG. 1 illustrates a front view of enhanced infinity mirror 100 in accordance with some embodiments presented herein. Enhanced infinity mirror 100 may include mirror chamber 110 and base 120.

Mirror chamber 110 may house the infinity mirror and an embedded strip, grid, or other set of controllable light emitting diodes ("LEDs"), lasers, or other illumination sources (e.g., display screens). The illumination sources may enhance the optical illusion or effect created by the infinity mirror.

The infinity mirror may include two or more mirrors or reflective surfaces that are positioned relative to one another to create the illusion of depth with smaller and smaller reflections that appear to pass through the back of mirror chamber 110. In some embodiments, the infinity mirror includes a first reflective mirror (e.g., partially or highly reflective mirror) and a second reflective or one-way mirror.

The illumination sources may be distributed along the inside of the mirror border and/or in between the first reflective mirror and the second reflective or one-way mirror of the infinity mirror. In some embodiments, the set of controllable LEDs or the illumination sources may include hundreds or thousands of individually addressable LEDs that may be individually controlled to illuminate with a different color, brightness, patterning, sequencing, duration, and/or other visual property.

In some embodiments, mirror chamber 110 may include an open slot about the top surface, left side, or right side. The open slot may be used to swap in and out different mirrors of the infinity mirror. The different mirrors may have different curvatures (e.g., concave, convex, etc.), levels of reflectivity, different textures or patterns, refractivity, and/or other properties that alter the optical illusion and/or effect created by enhanced infinity mirror 100. For instance, the backmost mirror may be pulled out from the top of mirror chamber 110 through the open slot, and a new backmost mirror of the same shape but with a different curvature may be inserted into the open slot. Changing the curvature of the one or more mirrors (e.g., changing from a convex to a concave mirror) produces a change in the optical illusion created by enhanced infinity mirror 100. More specifically, changing the curvature of the one or more mirrors may change the perceived depth of the illusion created by enhanced infinity mirror 100.

Rather than swapping the mirrors within mirror chamber 110, different filters or lens may be inserted through the open slot to change the mirror properties or infinity effects created by enhanced infinity mirror 100. For instance, a refraction lens may be inserted in front of the frontmost mirror, and may blur the infinity effect created by enhanced infinity mirror 100. Other filters may include patterns or designs to block specified parts of the created illusions while allowing other parts to be seen.

In some embodiments, mirror chamber 110 may support the swapping or changing of the light sources within mirror chamber 110. For instance, mirror chamber 110 may include a port, door, or interface that provides access to the inside of mirror chamber 110. With access to the inside of mirror chamber 110, a user may attach different types of light sources (e.g., red, green, and blue light sources, red, green, blue, and white light sources, black light or mono-chromatic light sources, etc.), strips with different numbers of light sources, and/or different visual or lighting effects to mirror chamber 110. For instance, mirror chamber 110 may support the insertion of light sources and/or mirrors that produce a kaleidoscopic effect, a three-dimensional holographic effect, and/or other effects.

Additionally, with access to the inside of mirror chamber 110, the user may insert objects inside mirror chamber 110 that become part of the infinity effect. For instance, the infinity effect may include reflecting an inserted object an infinite number of times. The objects may include light diffusers, landscape images, crystals, artwork, sculptures, logos, and/or other items that may be suspended or otherwise inserted in mirror chamber 110 to enhance or modify the infinity effect.

In some embodiments, mirror chamber 110 may include means for equalizing air pressure within mirror chamber 110 to prevent bending or distortion of the created effects from changing air pressure inside mirror chamber 110. For instance, each mirror chamber 110 may include a membrane that allows air into mirror chamber 110 and that prevents moisture or other matter from entering inside mirror chamber 110. Alternatively, mirror chamber 110 may be sealed with a gas (e.g., Argon) that maintains even pressure inside when mirror chamber 110 is used at different altitudes or in different atmospheric conditions. Gaskets and other deforming materials may be used to withstand changes in pressure without altering the effects created within mirror chamber 110. In some embodiments, mirror chamber 110 may include an antifog coating or means for controlling the humidity inside mirror chamber 110 to prevent moisture accumulation and/or fogging of the reflective surfaces. Additionally, mirror chamber 110 may be sealed for use underwater or to prevent damage from water or moisture.

In some embodiments, mirror chamber 110 may include one or more actuators or motors for changing the positioning of one or more of the mirrors or reflective surfaces within mirror chamber 110. For instance, the one or more actuators may change the angle or may increase or decrease the curvature (e.g., the concavity or convexity) of one of the mirrors to alter the depth of the optical illusion created by enhanced infinity mirror 100 or to change the direction and/or angle of the optical illusion relative to the user.

Figure 2:
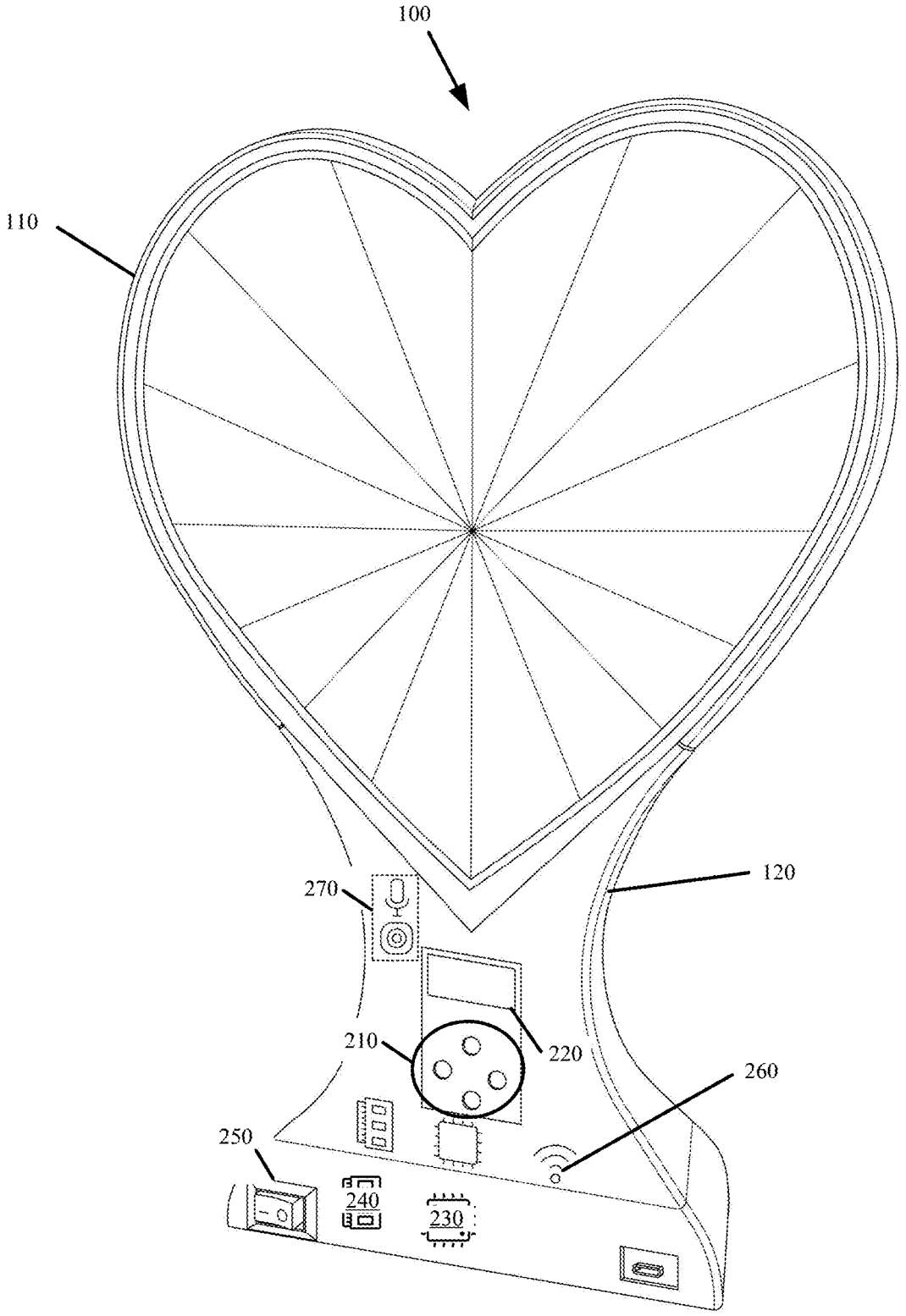
FIG. 2 illustrates a rear view of the enhanced infinity mirror with the components and/or circuitry integrated within the base in accordance with some embodiments presented herein.

In some embodiments, base 120 may house the components and/or circuitry for configuring and/or controlling the infinity, lighting, and/or other effects created by enhanced infinity mirror 100. FIG. 2 illustrates a rear view of enhanced infinity mirror 100 with the components and/or circuitry integrated within base 120 in accordance with some embodiments presented herein.

As shown in FIG. 2, base 120 may include a set of physical controls 210, display 220, controller 230, memory 240, power supply 250, wireless radio 260, one or more sensors 270, and/or other components and/or circuitry for powering and controlling enhanced infinity mirror 100.

Physical controls 210 may include a set of buttons, switches, dials, and/or other physical inputs. Physical controls 210 may be used to navigate through a user interface ("UI"). The UI may include a set of menus for configuring the illumination of mirror chamber 110. For instance, the set of menus may include a first layer for cycling through and selecting a particular illumination pattern from a plurality of illumination patterns stored in memory 240.

In response to selecting a particular illumination pattern in the first layer of menus, the UI may expose a second layer of menus for selecting one or more properties of the particular illumination pattern to adjust. For instance, the second layer of menus may include selectable UI elements for adjusting the coloring, brightness, speed, and/or effect of the particular illumination pattern.

Selection of the UI element for the coloring adjustment may present a third menu layer for changing the colors for the particular illumination pattern, changing the colors of individual LEDs, changing the hue, saturation, and/or intensity of the selected colors for the particular illumination pattern, and/or changing other coloring information using physical controls 210. Selection of the UI element for the brightness adjustment may present a third menu layer for increasing or decreasing the brightness of the particular illumination pattern using physical controls 210. Selection of the UI element for the speed adjustment may present a third menu layer for changing the speed at which to cycle through the particular illumination pattern (e.g., cycle through a defined set of illuminations) using physical controls 210. Changing the speed may include changing the rate at which the LEDs change color or transition through colors according to the particular illumination pattern. Selection of the UI element for the effects adjustment may present a third menu layer for changing strobing, flashing, and/or other effects associated with the particular illumination pattern using physical controls 210.

The menu layering described above is presented for example purposes only. The UI may support other menu configurations, arrangements, and/or functionality. For instance, the UI may include a timer to automatically turn on or off enhanced infinity mirror 100, pattern transitioning settings (e.g., instantly cycle to a next pattern, fade out a last pattern before fading in a new pattern, etc.), selecting different patterns to combine or layer in order create new effects, configuring different subsets of the light sources with different patterns, enabling sound reactivity, controlling or configuring wireless settings, enabling or disabling sensors, and/or other controls.

The UI and/or navigation through the set of menus may be presented on display 220. Display 220 may allow the user to track progression through the menu system. In some embodiments, physical controls 210 may be replaced by a touch sensitive display 220 (e.g., a touchscreen). In some embodiments, display 220 may project onto a nearby surface or may be positioned within mirror chamber 110 for display with the infinity mirror effects.

Enhanced infinity mirror 100 may also be configured, modified, and/or controlled via wireless radio 260, a Universal Serial Bus ("USB") port, or through another wired interface to base 120. In some such embodiments, a user device (e.g., a smartphone, smartwatch, tablet, desktop computer, remote control, etc.) may execute an application that presents the same or similar menu system as base 120 on a separate display of the user device, and may send messaging for controlling or changing the illumination of enhanced infinity mirror 100 to wireless radio 260, USB port, or other interface. The messaging may be passed to controller 230 where the messaging is processed and used to control the illumination of the illumination sources or LEDs in mirror chamber 110. In some embodiments, the application on the user device may mirror the menu system that is presented on display 220, or may provide a different UI with similar functionality for selecting the illumination pattern, adjusting the coloring, brightness, speed, effects, and/or other illumination properties of the LEDs, lasers, and/or other illumination sources within mirror chamber 110.

Memory 240 may store a variety of illumination patterns, lighting effects, and/or other infinity effects that may be generated by enhanced infinity mirror 100. Memory 240 may also store statistical data that may be communicated back to a central site or server of the manufacturer or online marketplace. The statistical data may identify the popularity of different illumination patterns based on the number of times or duration a pattern is configured or used on a particular mirror. The statistical data may capture user interest in different effects or settings. For instance, the statistical data may reveal that most users prefer a fade effect over a strobing effect. The statistical data may track battery life, overall usage, when enhanced infinity mirrors 100 are used, and/or other information that may be used to market new illumination patterns, mirror functionality, and/or mirror designs to the user. Controller 230 may automatically upload the statistical data to a central server or site for processing via wireless radio 260.

Controller 230 may control the illumination of the different light sources within mirror chamber 110 according to a selected pattern. The pattern may include one of several predefined patterns that are stored in memory 240, or a user-defined and/or application-defined pattern that is created on a user device and uploaded into memory 240. Controller 230 may address each light source individually, and thereby illuminate each light source with a different color, brightness, and/or other property at different points of time.

Controller 230 may interface with wireless radio 260 to receive user-defined patterns and/or control messaging from a user device, and/or to synchronize the illumination of enhanced infinity mirror 100 with the illumination of other enhanced infinity mirrors 100 as further described below. Controller 230 may use wireless radio 260 to pass messaging to the user device or the application running on the user device. For instance, the messaging from controller 230 may be used to update the application with any configuration changes that were made using physical controls 210. In other words, controller 230 may remain synchronized with the application on the user device regardless of whether changes are made on the application or by physical controls 210 on the mirror.

Controller 230 may receive input from one or more sensors 270, and may use the sensor input to generate dynamic lighting and/or infinity effects. One or more sensors 270 may include a microphone that measures and/or detects sound. Controller 230 may use the sound measurements to adjust the illumination of the LEDs in concert with changes to the sound, and/or to dynamically adjust the pattern that is selected for illumination. In other words, one or more sensors 270 allow enhanced infinity mirror 100 to become sound reactive, wherein the sound reactive enhanced infinity mirror 100 may produce dynamic lighting effects or may adjust illumination patterns based on the sound reactivity.

In some embodiments, one or more sensors 270 may include external sensors and/or sensors that wirelessly provide input to controller 230. For instance, one or more sensors 270 may include IoT devices, external cameras, external microphones, etc. that are connected to controller 230, and that wirelessly transmit sensed data to controller 230 via wireless radio 260.

In some embodiments, controller 230 may receive an analog and/or digital feed of audio and/or video through wireless radio 260 and/or an input port in base 120. Controller 230 may process the digital feed to detect changes in the audio and/or video, may dynamically generate an illumination pattern based on the detected changes in the digital feed, and may illuminate the LEDs of mirror chamber 110 according to the dynamically generated illumination pattern. In some such embodiments, enhanced infinity mirror 100 may react to changing images or video frames, and/or may dynamically generate illumination patterns based on a digital or analog feed received from an external source.

One or more sensors 270 may include a camera for motion detection and/or touch sensors. Different gestures or touch actions may be used to navigate the menu system, change the illumination of enhanced infinity mirror 100, and/or cause enhanced infinity mirror 100 to become user reactive. For instance, controller 230 may generate a dynamic illumination pattern that dances, changes, and/or otherwise reacts to the speed, range, and amount of user body movements that are detected using one or more sensors 270. As described below, enhanced infinity mirror 100 may have different form factors that allow enhanced infinity mirror 100 to be worn as an accessory or jewelry. In some such embodiments, one or more sensors 270 may include accelerometers, gyroscope, and/or other motion detection sensors that may track body movements of the user, and may generate dynamic illumination patterns based on the tracked body movements.

In some embodiments, enhanced infinity mirror 100 may be connected to a Digital Multiplex ("DMX") controller, and may receive the sound, light, and/or video input from the DMX controller. For instance, the DMX controller may be used to adjust lighting and/or sound at an event. Enhanced infinity mirror 100 may receive signaling from the DMX controller for when the sound and/or lighting changes, and may generate lighting or infinity effects in proportion or in response to those changes.

One or more sensors 270 may include a Global Positioning System ("GPS") module of a connected user device or a GPS module that is integrated in enhanced infinity mirror 100. The GPS data may be used to generate illumination patterns that direct a user to another user, location, or destination of interest. For instance, the illumination pattern may act as a compass by generating a dynamically changing arrow that points in the direction of the targeted user or device. Additionally, different enhanced infinity mirrors 100 may exchange GPS data with one another or may provide the GPS data to a single device. The device may then determine the relative positioning of enhanced infinity mirrors 100 relative to one another based on the shared GPS data, and may generate collective visual effects based on the relative positioning of enhanced infinity mirrors 100.

In addition to the GPS data, other sensor data may be shared with the central controller or between different enhanced infinity mirrors 100. For instance, one or more sensors 270 within each enhanced infinity mirror 100 may be used to detect distance from a concert speaker or to triangulate the location of the concert speaker, and the central controller may generate an illumination pattern that disperses from enhanced infinity mirrors 100 that are closest to the sound source (e.g., the concert speaker) to enhanced infinity mirrors 100 that are furthest from the sound source.

In some embodiments, controller 230 may provide instructions for activating and/or controlling the actuators or motors that control the relative positioning of the mirrors within mirror chamber 110. In some such embodiments, controller 230 may use the actuators or mirrors to change the mirror positioning in response to changes in an illumination pattern and/or in response to a dynamically generated pattern based on sound reactivity, user gestures, and/or other input that is detected using one or more sensors 270. In some other embodiments, controller 230 may control the actuators or mirrors based on other inputs such as power draw, geolocation, remaining battery life, etc.

In some embodiments, controller 230 may use electrical pulses to alter properties of the mirrors within mirror chamber 110 when the mirrors are made of electrochromatic or other reactive glass. In some other embodiments, the mirrors may have an electrochromatic coating that may be activated by the controller 230, or may include additional pieces of glass or acrylic that change tinting, coloring, and/or reflectiveness in response to signaling from controller 230. For instance, controller 230 may alter the tinting, coloring, and/or reflectiveness of the mirrors within mirror chamber 110 to further enhance the visual effects created via the different illumination patterns. In other words, controller 230 may change the tinting, coloring, and/or reflectiveness of the mirrors to coincide with different stages of an illumination pattern. In some embodiments, controller 230 may change the tinting, coloring, and/or reflectiveness of the mirrors by activating controllable light of a specific wavelength that increases or decreases tinting produced by a photochromatic coating on the mirrors. The controllable light may be focused on specific sections or regions of the mirrors to provide different tinting, coloring, and/or reflectiveness at those specific sections or regions. In some embodiments, the controllable light may include one or more moveable lasers that controller 230 may control to draw symbols, words, logos, or other patterns on the integrated mirrors.

Power supply 250 may include a plug or cord for connecting to a continuous supply of power (e.g., a power outlet). Alternatively, or additionally, power supply 250 may include a battery to power the illumination of enhanced infinity mirror 100 without having to plug the mirror into an outlet.

Controller 230 may monitor power supply 250 to compute power draw and/or battery life, and to dynamically alter the illumination patterns based on the computed power draw and/or battery life. For instance, a user may input an illumination duration, and controller 230 may automatically adjust the pattern, brightness, and/or other properties of the light sources when the mirror is powered by a battery so that enhanced infinity mirror 100 will remain on for the specified illumination duration. Controller 230 may also provide outputs via display 220 or the application as to remaining battery life when the pattern, brightness, and/or other properties of the light sources change. Similarly, controller 230 may calculate the amount of power that an illumination pattern is expected to consume based on the number, duration, and intensity of the light sources used in that illumination pattern.

Controller 230 may adjust the power draw and/or battery life calculations over time as the battery degrades or the light source intensity fades over time. The calculations may also be used for quality control and/or calibration purposes. For instance, light sources of enhanced infinity mirror 100 may be expected to draw a certain amount of power, and controller 230 may increase or decrease brightness settings based on the actual power drawn by those light sources.

In some embodiments, one or more of the components integrated within base 120 may be integrated within mirror chamber 110. For instance, one or more of set of physical controls 210, display 220, controller 230, memory 240, power supply 250, wireless radio 260, one or more sensors 270, and/or other components and/or circuitry for powering and controlling enhanced infinity mirror 100 may be moved from base 120 inside or to the back of mirror chamber 110.

Figure 3:
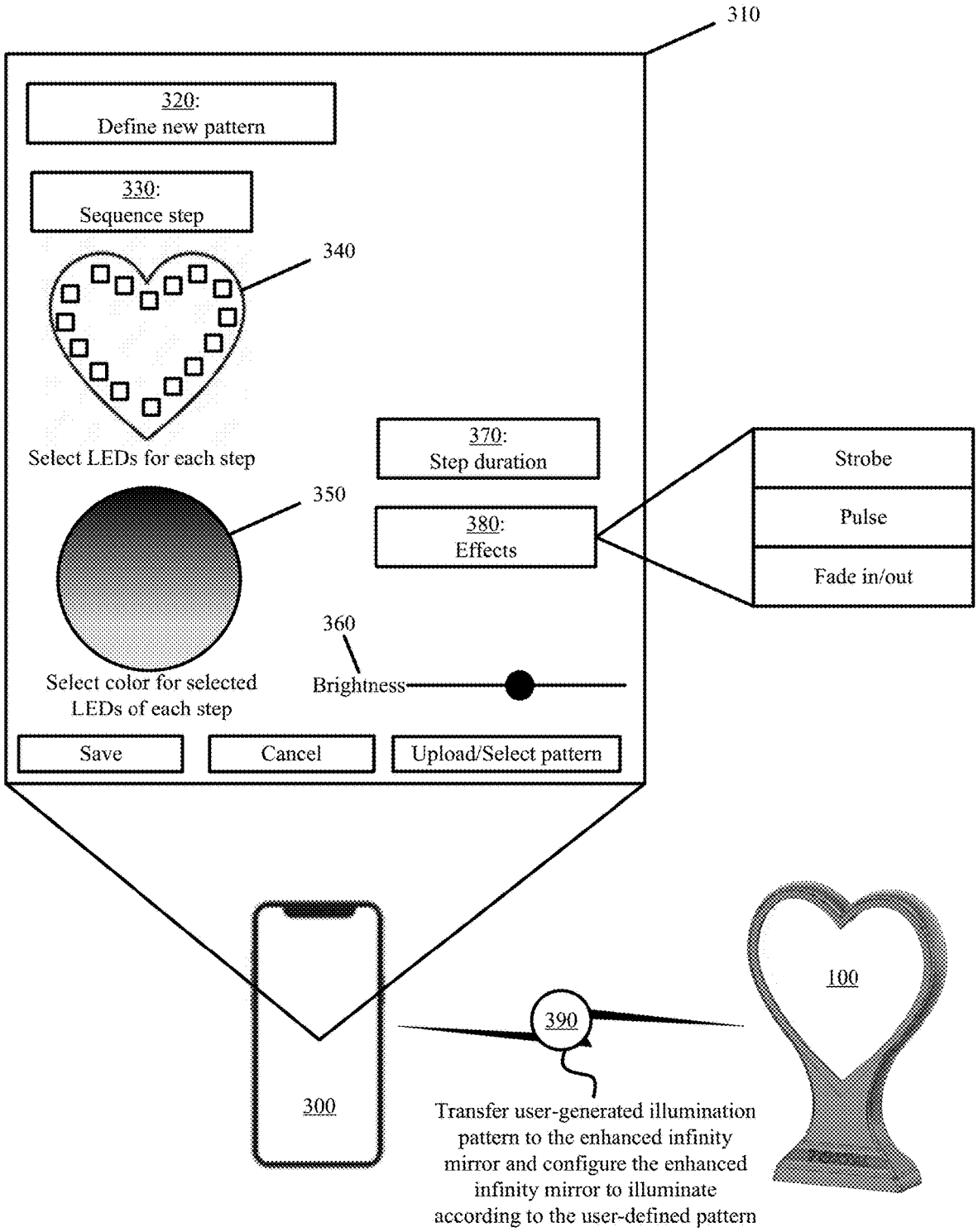
FIG. 3 illustrates an example system for controlling and generating custom mirrored effects on the enhanced infinity mirror with a remotely connected user device in accordance with some embodiments presented herein.

FIG. 3 illustrates an example system for controlling and generating custom mirrored effects on enhanced infinity mirror 100 with remotely connected user device 300 in accordance with some embodiments presented herein. User device 300 may include a smartphone, smartwatch, tablet, desktop computer, remote control, and/or other device with one or more hardware processors and wireless connectivity.

User device 300 may connect to enhanced infinity mirror 100 using the wireless connectivity. Once connected, user device 300 may execute application 310 that provides a UI for controlling operation of enhanced infinity mirror 100.

Application 310 may provide various selectable and/or interactive elements 320, 330, 340, 350, 360, 370, and 380 for controlling the illumination of enhanced infinity mirror 100. In some embodiments, application 310 may be used to generate and upload new illumination patterns directly to memory 240, an online repository, or a marketplace where the patterns may be accessed by different users. For instance, the application may provide selectable elements 320, 330, 340, 350, 360, 370, and 380 for defining a sequence of illumination for the LEDs of mirror chamber 110. Defining the sequence of illumination may include selecting different LEDs from the set of LEDs in mirror chamber 110 to illuminate with configurable colors and/or brightness at different times, and/or different periodic or cyclical changes to the coloring and/or brightness of the set of LEDs. Selectable element 380 may include predefined effects to apply to the selected LEDs including different strobing, flashing, or other effects for different subsets of the LEDs.

For instance, the user may interact with selectable element 320 to request the creation of a new illumination pattern. The user may invoke selectable element 330 to define then number of steps for the pattern sequence. Each step may correspond to a different change to the LEDs. Accordingly, a four sequence step pattern may cause mirror chamber 110 to cycle through four different LED illuminations.

For each step, the user may invoke selectable element 340 to specify the LEDs that will be illuminated during that step. The user may select to illuminate all the LEDs or some set of the user's choosing. For instance, the user may select evenly spaced LEDs for a first step of the sequence and oddly spaced LEDs for a second step of the sequence. By selecting which LEDs to illuminate at different times, the user may create a multitude of different effects.

The user may interact with selectable element 350 in order to specify the color with which each selected LED illuminates for a given step. The user may configure all selected LEDs to illuminate with the same color during a particular step of the pattern or sequence, or may configure the color of each LED individually. For instance, selectable element 340 may be used to select a first LED for a first step of the sequence, selectable element 350 may be used to configure a first color with which the first LED illuminates during the first step, selectable element 340 may be used to select a different second LED for the same first step, and selectable element 350 may be used to configure a different second color with which the second LED illuminates during the first step. In this manner, the user may configure the first LED and second LED to illuminate with different colors during the same step of the pattern or sequence.

Similarly, the user may interact with selectable element 360 to set the brightness with which each selected LED for each step of the sequence is to illuminate. If two or more LEDs are selected using selectable element 340, selectable element 360 may be used to simultaneously adjust the brightness of the selected two or more LEDs, and application 310 and/or memory 240 of enhanced infinity mirror 100 may store each configured setting for each LED as part of the pattern definition.

Selectable element 370 may control the duration with which each step of the pattern is active or is illuminated. Accordingly, selectable element 370 may be used to configure a first duration with which a first set of LEDs are illuminated with a first set of colors and brightness for a first step of the pattern, and to configure a second duration with which a second set of LEDs are illuminated with a second set of colors and brightness for a second step of the pattern.

Selectable element 380 may configure predefined effects to apply to the selected LEDs for each step of the sequence. For instance, selectable element 380 may cause the selected LEDs to pulse, fade in and out (e.g., increase and decrease brightness), strobe, and/or change according to other predefined effects.

Once the user completes the pattern definition, application 310 may save (at 390) the pattern definition locally or in memory 240 of enhanced infinity mirror 100. The pattern definition may include a file that defines for each step of the pattern which LEDs to illuminate, the color for each LED, the brightness for each LED, the illumination duration, and/or other effects to apply when illuminating the selected LEDs for each step. In some embodiments, saving the pattern definition may include wirelessly transferring the pattern definition from user device 300 into memory 240 or other non-volatile storage of enhanced infinity mirror 100, and configuring enhanced infinity mirror 100 to illuminate according to the user-defined pattern definition.

Rather than individually set the illumination for each LED for each step of a pattern, application 310 may receive a form that the user wishes to be displayed with an infinity effect on enhanced infinity mirror 100. The form may be a drawing that the user creates or uploads in the UI of application 310, a letter, a shape, a design, etc. Application 310 may analyze the form relative to the positioning of the LEDs, and may dynamically generate the pattern that illuminates a particular set of LEDs within mirror chamber 110 that align with a different part of the form.

In some embodiments, the user may create a video of a desired illumination pattern. The video may include several frames, and each frame may present different colors at different regions. Application 310 may receive the video, may analyze each frame of the video, may map the illumination and/or coloring detected in each frame into a corresponding illumination of the LEDs, and may configure enhanced infinity mirror 100 according to the mapping or illumination pattern that is generated from the detected changes in colors at different regions of the video frames.

In some embodiments, application 310 may include a selectable element with which different saved pattern definitions may be reused or shared between enhanced infinity mirrors 100 of different users. Rather than define an illumination pattern each time, the user may switch between saved illumination patterns that they created or that were created by others.

In some embodiments, application 310 may integrate and/or may control illumination of enhanced infinity mirror 100 based on inputs provided by a voice assistance. For instance, a user may speak the audible command "Hey Assistance, illuminate pattern_X". The audible command may be translated to a command that causes application 310 to configure enhanced infinity mirror 100 with the pattern that is named or tagged with the "pattern_X" identifier. The voice assistant may also be used to select illumination patterns based on a mood, feeling, effect, and/or other metadata tag. For instance, a first set of defined patterns may be tagged with the "happy" tag, and a second set of defined patterns may be tagged with the "dance" tag. The user may speak the audible command "Hey Assistant, give me dance lighting", the voice assistance may call application 310 with a request to select a pattern with the "dance" tag, and application 310 may configure enhanced infinity mirror 100 to illuminate with one or more of the second set of defined patterns.

In some embodiments, application 310 may configure enhanced infinity mirror 100 with dynamically generated illumination patterns and/or infinity effects. For instance, enhanced infinity mirror 100 may be configured with algorithms or mathematical formulas that generate varying illumination patterns. Additionally, the algorithms or mathematical formulas may accept audio, visual, and/or other input from one or more sensors 270 in order to dynamically generate illumination patterns that change based on changing sounds, lights, visuals, and/or other input from the surrounding environment.

In some embodiments, application 310 may dynamically generate an illumination pattern based on inputs received from a camera, microphone, GPS sensor, gyroscope, or other sensor of user device 300. For instance, application 310 may dynamically modify an illumination pattern that is presented on enhanced infinity mirror 100 based on changes in the ambient or environmental light detected by the camera of user device 300, the sound detected by the microphone of user device 300, and/or the orientation and position of user device 300 as detected by the GPS sensor or gyroscope of user device 300.

In some embodiments, application 310 may be used to create and upload a notification-based or real-time illumination pattern. The notification-based or real-time illumination pattern may include an illumination pattern that is dynamically created based on different notifications received on user device 300 or different events that occur on the user device or on other applications running on the user device.

Figure 4:
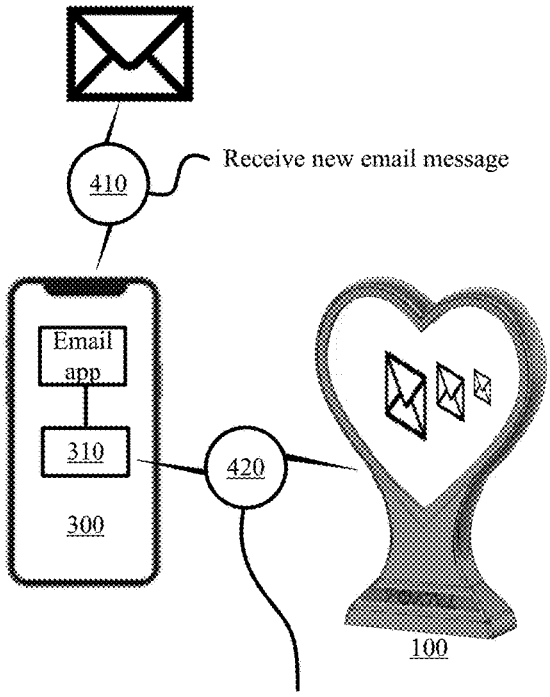
FIG. 4 illustrates an example of notification-based illumination of the enhanced infinity mirror in accordance with some embodiments presented herein.
Figure 4:
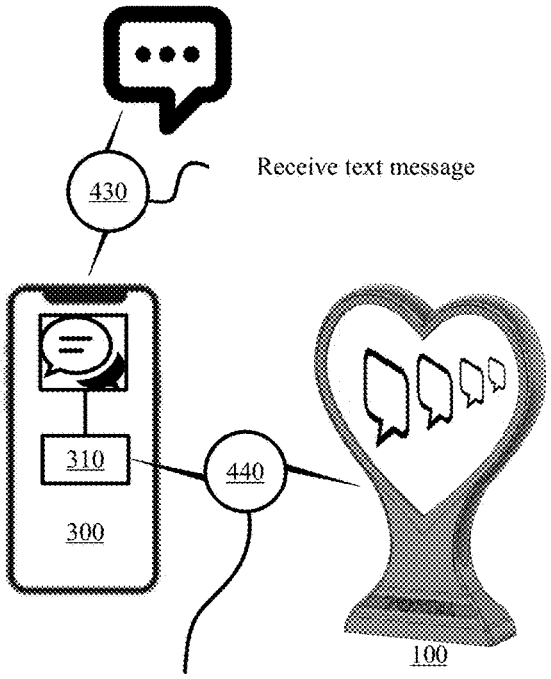

FIG. 4 illustrates an example of notification-based illumination of enhanced infinity mirror 100 in accordance with some embodiments presented herein. As shown in FIG. 4, user device 300 may receive (at 410) a new email, and application 310 may configure (at 420) enhanced infinity mirror 100 in real-time to illuminate with a first pattern (e.g., a set of light sources with a specific sequence of colors, brightness, lighting effects, etc.) that creates a first infinity effect associated with a new email notification. For instance, the first pattern may generate a visual representation of an email with an infinity effect.

FIG. 4 also illustrates user device 300 receiving (at 430) a text message or other notification (e.g., a push notification from one or more applications or services running on user device 300). Application 310 may detect the text message or other notification, and may configure (at 440) enhanced infinity mirror 100 in real-time to illuminate with a second pattern that creates a different second infinity effect associated with the text message or other notification.

In some embodiments, the notification-based or real-time illumination pattern may be based on notifications or messaging that are received on other devices. For instance, user device 300 may be connected to a smart thermometer or other Internet-of-Things ("IoT") device, and may generate a dynamic illumination pattern for enhanced infinity mirror 100 based on temperature readings from the smart thermometer. For instance, when the furnace or heater is activated, application 310 may configure the LEDs of enhanced infinity mirror 100 to illuminate with a reddish tone, and when the air conditioner is activated, application 310 may configure the LEDs of enhanced infinity mirror 100 to illuminate with a bluish tone. In some embodiments, the notifications may be distributed from a central server or another host or node within the Internet, and need not come application 310 directly.

Application 310 may configure different illumination patterns on different enhanced infinity mirrors 100 that are linked to application 310, a user account accessed via application 310, or user device 300 executing application 310. For instance, user device 300 may have a direct wired or wireless link to a first enhanced infinity mirror in the user's home or office, and may configure the first enhanced infinity mirror with a first illumination pattern. User device 300 may also have an indirect link to a second enhanced infinity mirror of a friend in an entirely different city, state, or country. For instance, the friend may provide permissions to the user's account that allow the user to remotely configure a second illumination pattern on the second enhanced infinity mirror of the friend. In this manner, the user may communicate with the friend via the illumination patterns that the user sends to the friend's enhanced infinity mirror.

Figure 5:
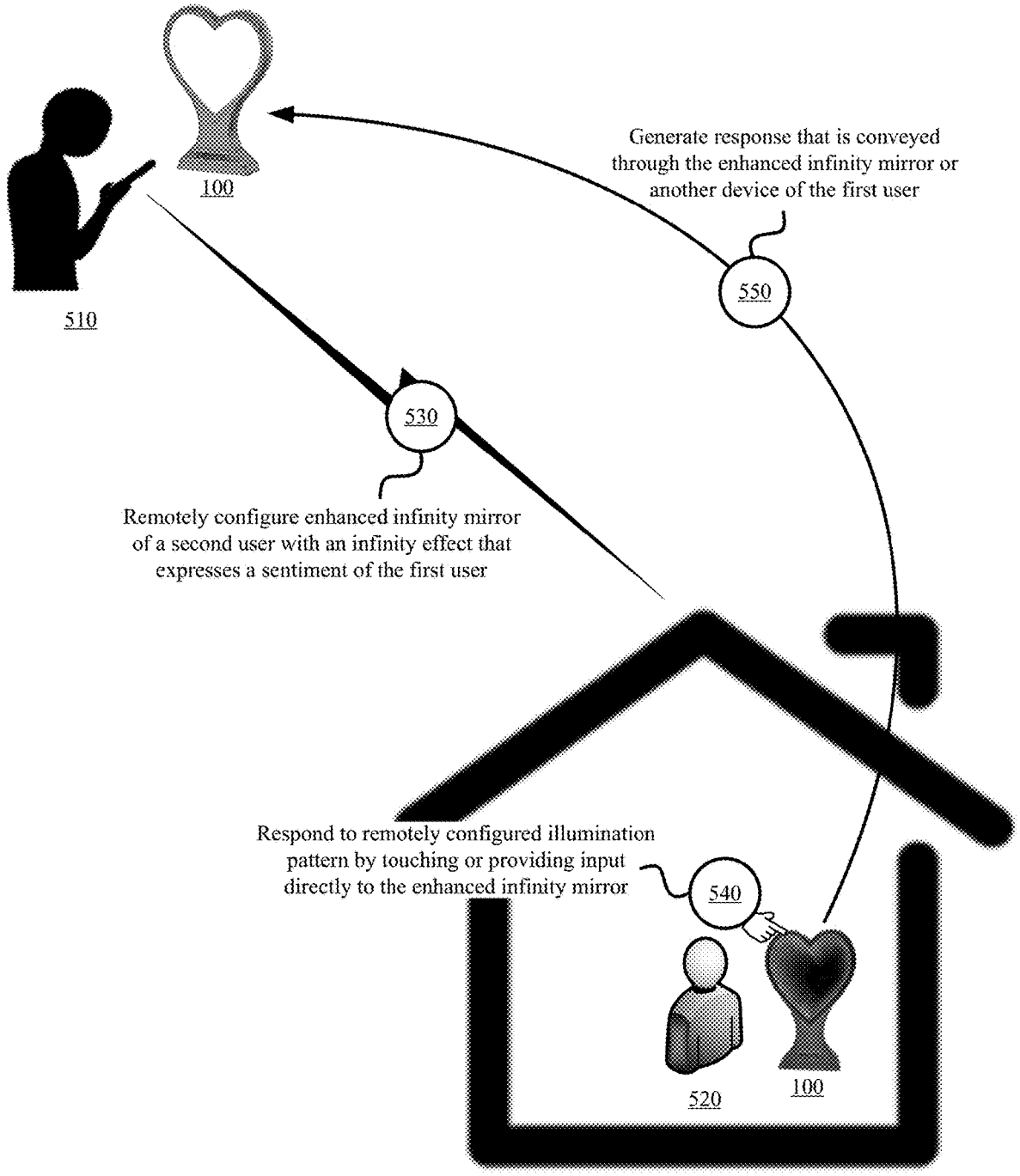
FIG. 5 illustrates an example of communicating with remote contacts via the enhanced infinity mirror in accordance with some embodiments presented herein.

FIG. 5 illustrates an example of communicating with remote contacts via enhanced infinity mirror 100 in accordance with some embodiments presented herein. First user 510 may request access to enhanced infinity mirror 100 of second user 520. Second user 520 may grant first user 510 access. First user 510 may be located away from second user 520 in a different home, city, state, country, etc. Instead of, or in addition to, sending second user 520 a text message, photograph, image, or other communication that appears on the smartphone of second user 520, first user 510 may remotely configure (at 530) enhanced infinity mirror 100 with a particular illumination pattern that expresses a sentiment or creates a mood or ambiance. For instance, first user 510 may configure (at 530) a heart-shaped illumination pattern or other illumination patterns on enhanced infinity mirror 100 of second user 520 to greet, convey sentiment, or express other messages to second user 520 via the remotely controlled enhanced infinity mirror 100.

In some embodiments, second user 520 may directly communicate back to first user 510 via their enhanced infinity mirror 100. For instance, in response to seeing the illumination pattern that was sent by first user 510 on enhanced infinity mirror 100 of second user 520, second user 520 may touch, tap, or otherwise provide input (at 540) to enhanced infinity mirror 100 (e.g., physical controls 210), and enhanced infinity mirror 100 of second user 520 may send (at 550) a response back to first user 510. Sending (at 550) the response may include sending a message (e.g., "Thank you" text message) that is selected with the user-provided input via wireless radio 260 to user device 300 of first user 510, or remotely configuring enhanced infinity mirror 100 of first user 510 with a response illumination pattern.

In some embodiments, the operation of two or more enhanced infinity mirrors 100 may be synchronized to generate illumination patterns that span multiple enhanced infinity mirrors 100. For instance, multiple enhanced infinity mirrors 100 may exchange messaging with another or with a single instance of application 310 in order to synchronize the illumination of a common pattern across the multiple enhanced infinity mirrors 100, and to produce new lighting effects based on the synchronized operation of two or more enhanced infinity mirrors 100.

In some embodiments, physical controls 210 and/or application 310 may be used to wirelessly pair two or more enhanced infinity mirrors 100 together, and/or to designate one of the paired mirrors 100 as the primary. Physical controls 210 may be used to select a pattern on the primary mirror, and controller 230 of the primary mirror may provide the data or an identifier for the selected pattern to the other paired mirrors. Additionally, controller 230 of the primary mirror may provide the same or a different sequence value from the selected pattern to each of the other paired mirrors. The sequence value may specify a position within the selected pattern at which to begin the illumination. In other words, enhanced infinity mirrors 100 may be synchronized to produce the same set of illuminations at the same time, or may be synchronized to produce the set of illuminations at different times by starting at different starting points in the set of illuminations.

For instance, a selected pattern may cycle through 10 different illuminations. When the primary mirror instructs all paired mirrors to execute from the first illumination of the pattern, then all the paired mirrors will produce the same lighting effect and change to a next lighting effect at the same time.

Figure 6:
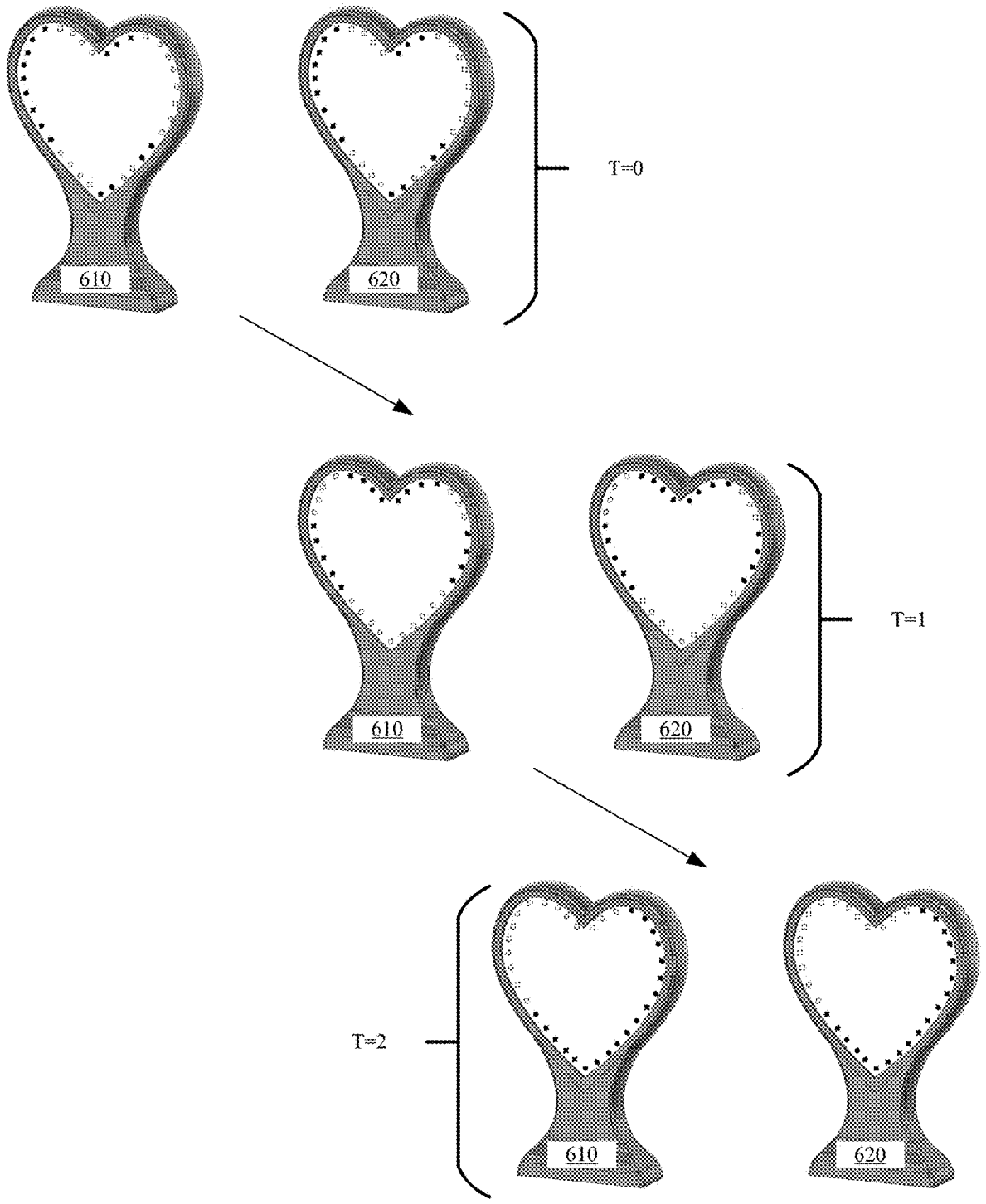
FIG. 6 illustrates two enhanced infinity mirrors that are synchronized to produce the same set of illuminations in accordance with some embodiments presented herein.

FIG. 6 illustrates two enhanced infinity mirrors 610 and 620 that are synchronized to produce the same set of illuminations in accordance with some embodiments presented herein. At a first time (e.g., T=0) both mirrors 610 and 620 may illuminate the same first set of LEDs with the same first set of colors, brightness, effects, and/or other visual characteristics. At a subsequent second time (e.g., T=1), both mirrors 610 and 620 change and illuminate a second set of LEDs with a second set of colors, brightness, effects, and/or other visual characteristics. In some embodiments, the primary mirror or application 310 may provide a signal to all other paired mirrors to change to the next illumination in the pattern or sequence.

Figure 7:
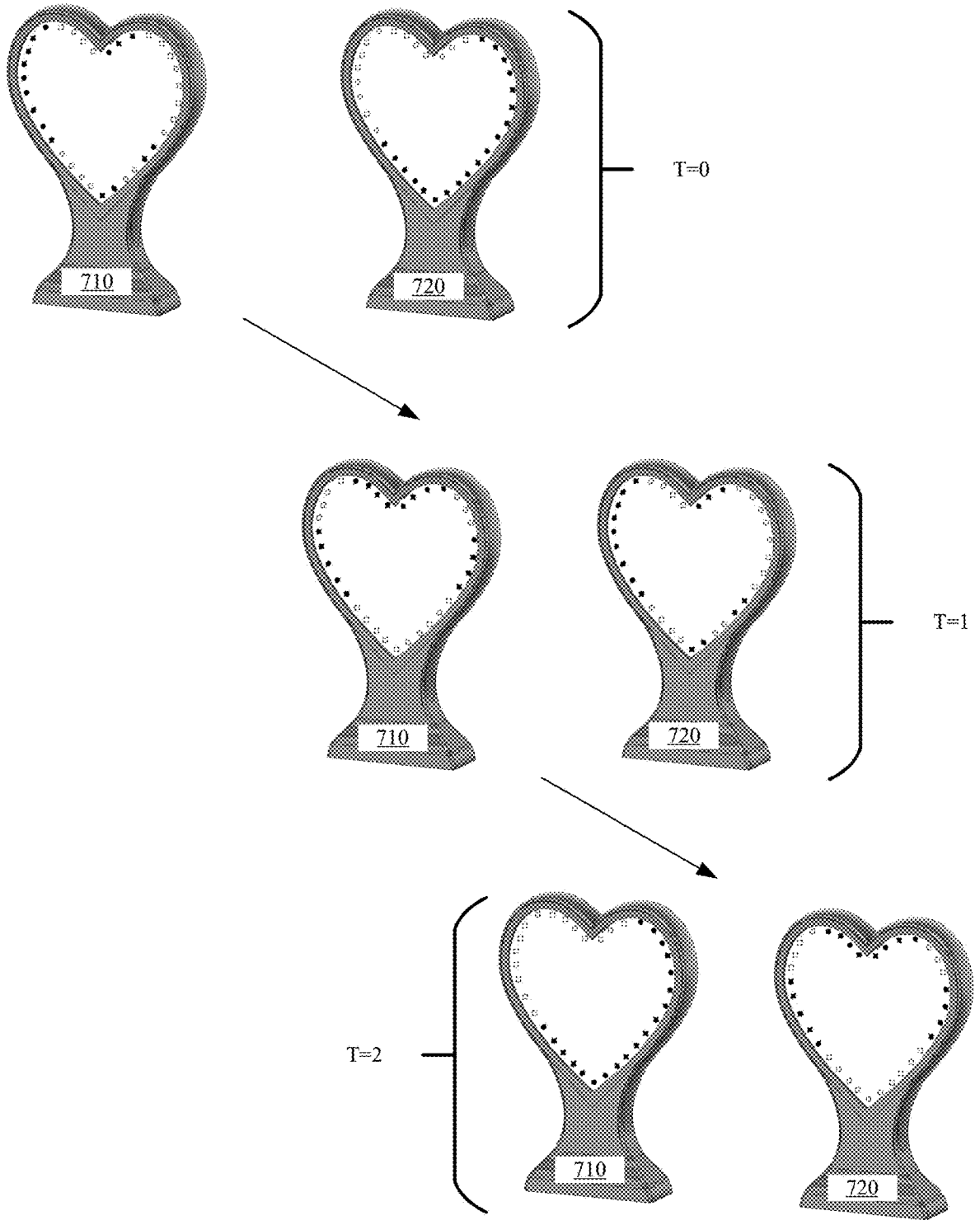
FIG. 7 illustrates two enhanced infinity mirrors that are synchronized to produce a staggered or offset presentation of the same set of illuminations in accordance with some embodiments presented herein.

However, if the primary mirror instructs the paired enhanced infinity mirrors 100 to start from a different illumination of the pattern, then the collective lighting effect may appear as if the mirrors are shifting the illumination pattern in a direction. FIG. 7 illustrates two enhanced infinity mirrors 710 and 720 that are synchronized to produce a staggered or offset presentation of the same set of illuminations in accordance with some embodiments presented herein. For instance, at a first time (e.g., T=0) first enhanced infinity mirror 710 may illuminate a first set of LEDs with a first set of colors, brightness, effects, and/or other visual characteristics, and second enhanced infinity mirror 720 may illuminate a second set of LEDs with a second set of colors, brightness, effects, and/or other visual characteristics. At a second time (e.g., T=1), the primary mirror or application 310 may signal first enhanced infinity mirror 710 to illuminate a third set of LEDs with a third set of colors, brightness, effects, and/or other visual characteristics, and may signal second enhanced infinity mirror 720 to illuminate the second set of LEDs with the second set of colors, brightness, effects, and/or other visual characteristics. Similarly, at a third time (e.g., T=2), the primary mirror or application 310 may signal first enhanced infinity mirror 710 to illuminate a fourth set of LEDs with a fourth set of colors, brightness, effects, and/or other visual characteristics, and may signal second enhanced infinity mirror 720 to illuminate the third set of LEDs with the third set of colors, brightness, effects, and/or other visual characteristics.

In some embodiments, user device 300 may wirelessly pair to two or more enhanced infinity mirrors 100, may synchronize the paired mirrors 100 to illuminate according to the same pattern, and may provide the same or different pattern sequence values to each of the paired mirrors 100 to achieve a desired lighting effect or lighting experience. Controller 230 of each enhanced infinity mirror 100 may operate according to the same clock or at the same frequency, and may therefore cycle through different illuminations for a common pattern at a common rate. In some embodiments, the synchronization may include setting different rates at which the synchronized enhanced infinity mirrors 100 cycle through the same pattern. In some embodiments, the synchronization may include setting each paired enhanced infinity mirror 100 to cycle through the same illumination pattern, but different color settings or brightness settings may be configured for the illumination pattern on different paired mirrors 100.

The synchronization may also allow for more intricate lighting effects with multiple enhanced infinity mirrors 100. For instance, multiple enhanced infinity mirrors 100 may be arranged in a particular order (e.g., horizontally in a row, vertically in a column, in a 2×2 square pattern, etc.), and each enhanced infinity mirror 100 may correspond to a single pixel or different part within an illumination pattern. Controller 230 of the primary mirror or application 310 controlling the synchronized mirrors 100 may partition a selected illumination pattern by the number of synchronized mirrors 100 and/or according to the arrangement of the synchronized mirrors 100, and may direct each synchronized mirror 100 to illuminate according to a different partitioned portion of the selected illumination pattern. The ordering of the enhanced infinity mirrors 100 may be determined based on GPS data that is obtained from the enhanced infinity mirrors 100, based on message latency between controllers 230 of the enhanced infinity mirrors 100, a user configuration in application 310, and/or other means of position detection.

Figure 8:
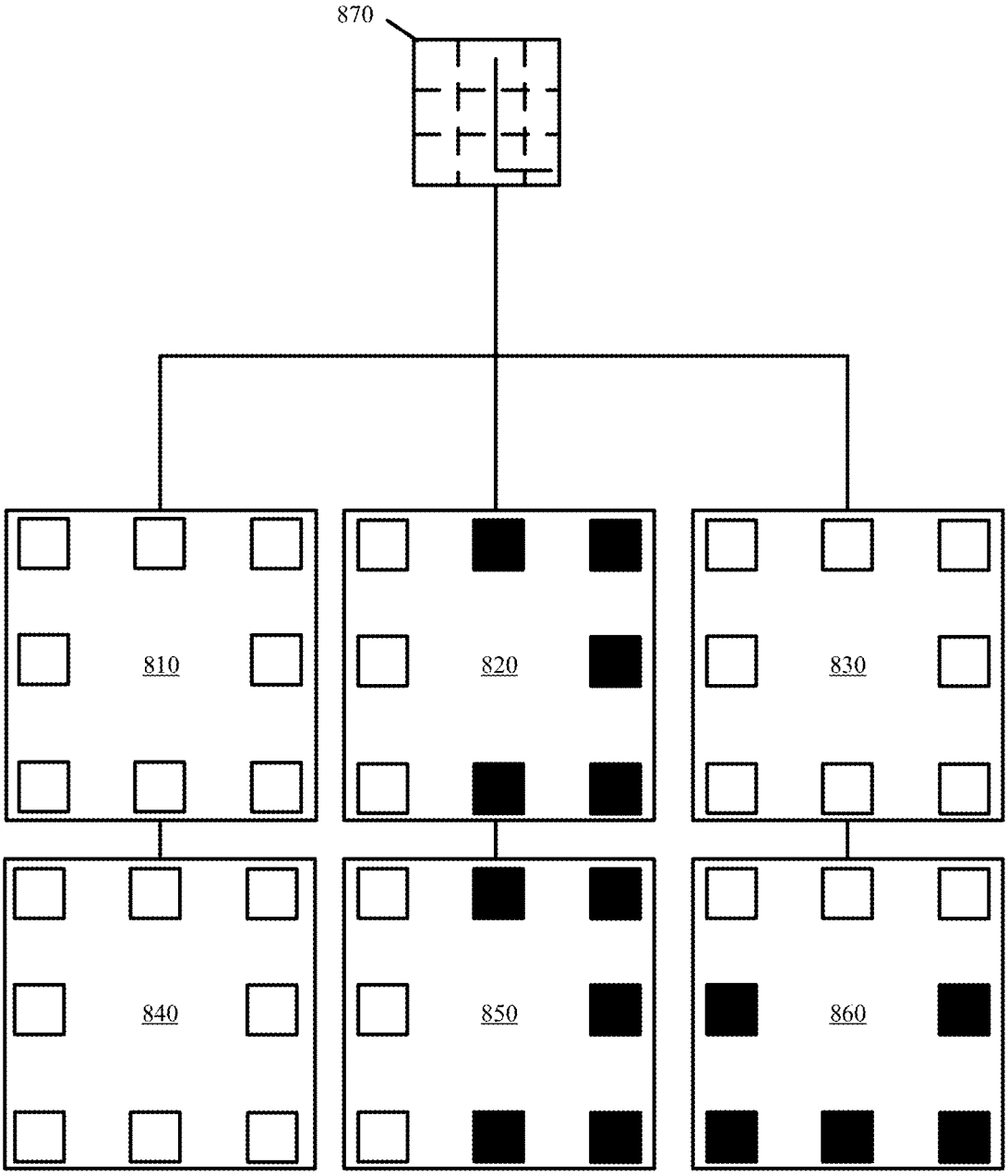
FIG. 8 illustrates an example set of enhanced infinity mirrors that are synchronized to illuminate different partitioned portions of a pattern in accordance with some embodiments presented herein.

FIG. 8 illustrates an example set of enhanced infinity mirrors that are synchronized to illuminate different partitioned portions of a pattern in accordance with some embodiments presented herein. As shown in FIG. 8, three enhanced infinity mirrors 810, 820, and 830 may be arranged in a top row, and another three enhanced infinity mirrors 840, 850, and 860 may be arranged in a bottom row. The six enhanced infinity mirrors 810, 820, 830, 840, 850, and 860 may be synchronized to illuminate "L" pattern 870.

A primary controller (e.g., one of the six synchronized mirrors 810, 820, 830, 840, 850, and 860 or application 310 on user device 300 that is paired to all six synchronized enhanced infinity mirrors 810, 820, 830, 840, 850, and 860) may partition "L" pattern 870 according to the layout of the six synchronized enhanced infinity mirrors 810, 820, 830, 840, 850, and 860. The primary controller may provide different illumination instructions, that correspond to the different partitioned portions of "L" pattern 870, to the synchronized enhanced infinity mirrors 810, 820, 830, 840, 850, and 860. The illumination instructions may specify which light sources (e.g., LEDs) on each of the synchronized enhanced infinity mirrors 810, 820, 830, 840, 850, and 860 to illuminate at a particular point in time, and also the brightness, speed, color, effects, and/or other visual attributes with which to illuminate those light sources at each particular point in time. Synchronized enhanced infinity mirrors 810, 820, 830, 840, 850, and 860 may then illuminate according to partitioned pattern 870.

In some embodiments, the partitioning of a pattern may account for the spatial positioning of each LED from each synchronized enhanced infinity mirror 100 in the arrangement. In this case, each LED may correspond to a different pixel or a different illuminable element within the collective lighting effect. The selected pattern may then include and/or illuminate some LEDs of a first enhanced infinity mirror 100, other LEDs of a different second enhanced infinity mirror 100, and may transition the illuminated pattern across different subsets of LEDs from those enhanced infinity mirrors 100.

Figure 9:
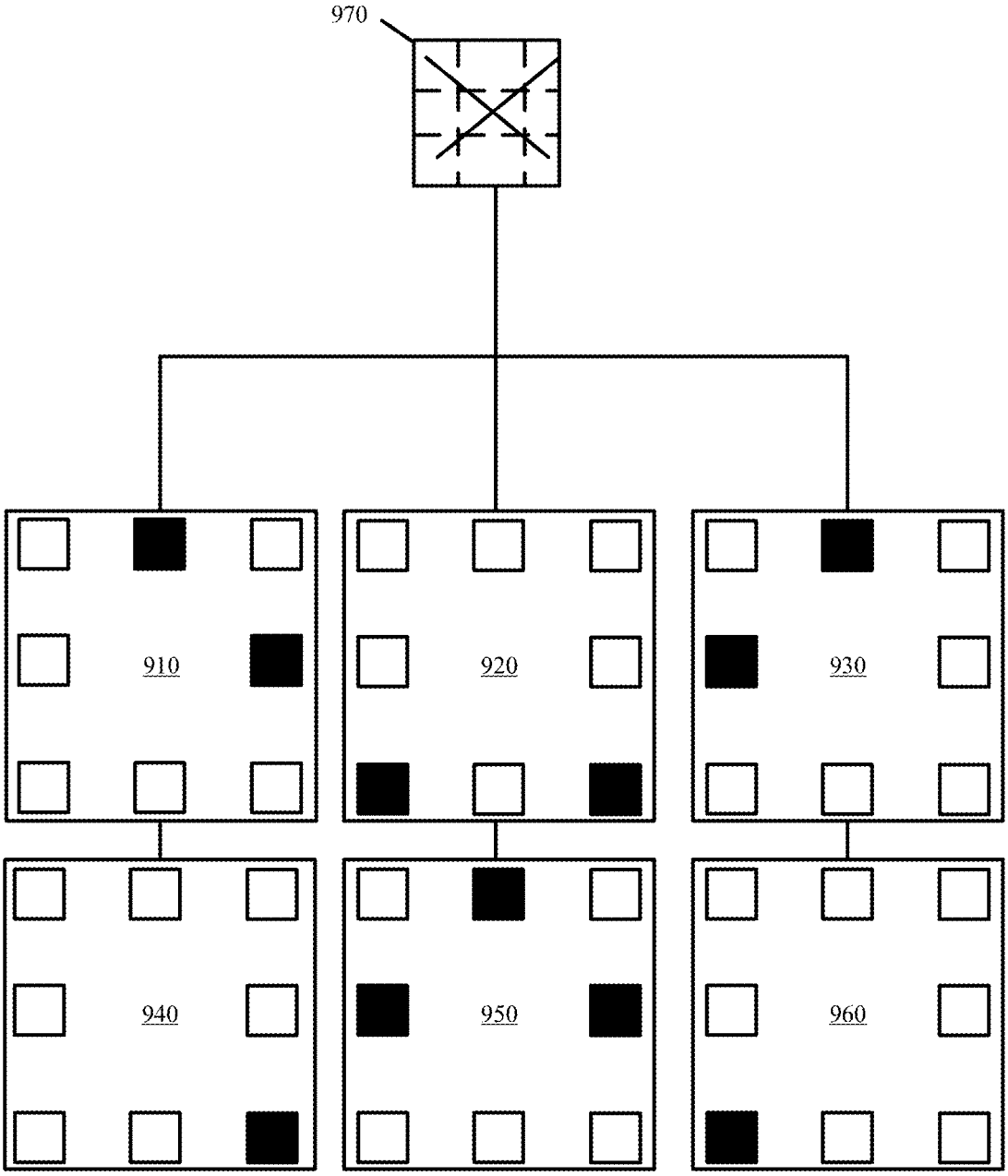
FIG. 9 illustrates an example of illuminating a partitioned pattern using the spatial positioning of individual lighting sources in a set of synchronized enhanced infinity mirrors in accordance with some embodiments presented herein.

FIG. 9 illustrates an example of illuminating a partitioned pattern using the spatial positioning of individual lighting sources in a set of synchronized enhanced infinity mirrors in accordance with some embodiments presented herein. In FIG. 9, six enhanced infinity mirrors 910, 920, 930, 940, 950, and 960 may be synchronized to illuminate "X" pattern 970. However, rather than represent each enhanced infinity mirror 910, 920, 930, 940, 950, and 960 as an individual pixel, the synchronized illumination of "X" pattern 970 across six enhanced infinity mirrors 910, 920, 930, 940, 950, and 960 accounts for the individual positioning of each lighting source in each enhanced infinity mirror 910, 920, 930, 940, 950, and 960, and partitions pattern 970 based on the individual lighting source positions in the synchronized arrangement.

In some embodiments, one of six enhanced infinity mirrors 910, 920, 930, 940, 950, and 960 may be designated as the primary mirror for controlling the synchronized illumination of "X" pattern 970 the other mirrors. For instance, physical controls 210 may be used to pair the primary mirror with the other enhanced infinity mirrors, select an arrangement of enhanced infinity mirrors 910, 920, 930, 940, 950, and 960, and select "X" pattern 970 to illuminate across the paired enhanced infinity mirrors 910, 920, 930, 940, 950, and 960 in the specified arrangement.

In some embodiments, a single instance of application 310 may be paired with each of the six enhanced infinity mirrors 910, 920, 930, 940, 950, and 960. A user may interact with application 310 to configure the arrangement of enhanced infinity mirrors 910, 920, 930, 940, 950, and 960 in the 2 rows, and to select "X" pattern 970 to illuminate based on the lighting source positioning of the collective set of enhanced infinity mirrors 910, 920, 930, 940, 950, and 960.

The primary mirror or application 310 may then control the illumination of "X" pattern 970 across the synchronized set of enhanced infinity mirrors 910, 920, 930, 940, 950, and 960. Consequently, the synchronized set of enhanced infinity mirrors 910, 920, 930, 940, 950, and 960 collectively produce "X" pattern 970 with different sets of LEDs from each synchronized enhanced infinity mirror 910, 920, 930, 940, 950, and 960 being illuminated. Although not shown in FIG. 9, the resulting lighting effect generates "X" pattern 970 with depth in a seemingly endless tunnel that extends through the backs of the set of synchronized enhanced infinity mirrors 910, 920, 930, 940, 950, and 960.

Figure 10:
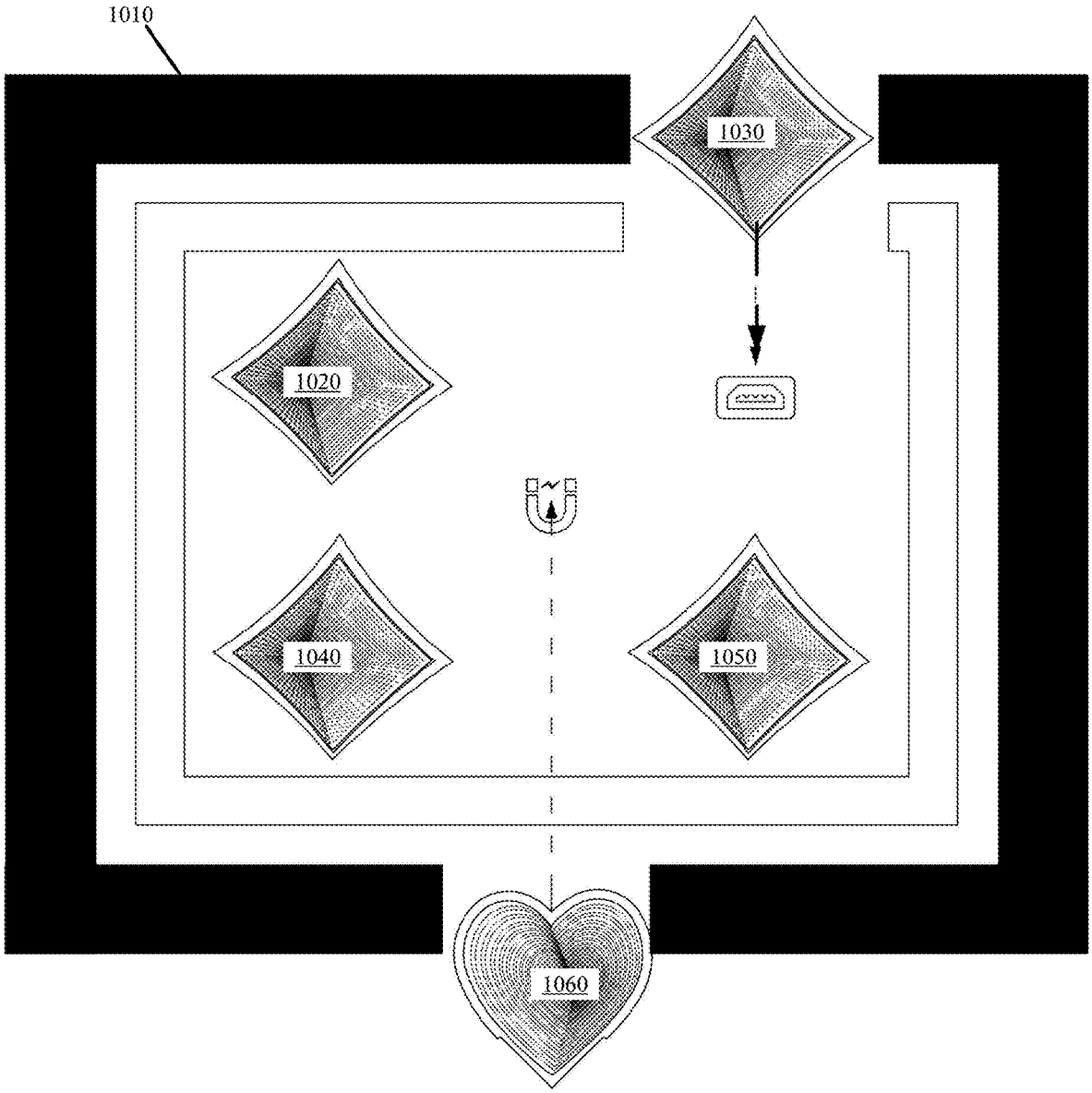
FIG. 10 illustrates an example of a panel for dynamically synchronizing mirror chambers of multiple enhanced infinity mirrors in accordance with some embodiments presented herein.

In some embodiments, enhanced infinity mirrors 100 may dynamically synchronize and organize relative to other enhanced infinity mirrors 100 through a plug-and-play or hot-swappable interface. FIG. 10 illustrates an example of panel 1010 for dynamically synchronizing mirror chambers 110 of multiple enhanced infinity mirrors 1020, 1030, 1040, 1050, and 1060 in accordance with some embodiments presented herein.

Panel 1010 may include a frame onto which mirror chambers 110 different enhanced infinity mirrors 1020, 1030, 1040, 1050, and 1060 may be attached and detached as desired. Panel 710 may include physical ports into which mirror chambers 110 of enhanced infinity mirrors 1020, 1030, 1040, 1050, and 1060 may be attached. In some embodiments, the physical ports may be exposed via a male USB connector or a female USB connector. Mirror chambers 110 of each enhanced infinity mirror 1020, 1030, 1040, 1050, and 1060 may have the opposite male or female connector in the back, and may attach directly to panel 1010 via insertion and/or coupling to one of the ports. Panel 1010 may support other types of physical ports and connectors (e.g., Ethernet cabling, pins, etc.). Each connector may be associated with a different panel address that identifies the position of an enhanced infinity mirror that is connected to panel 1010 at a specific port via the connector address.

In some other embodiments, panel 1010 may include hidden ports, and mirror chambers 110 of enhanced infinity mirrors 1020, 1030, 1040, 1050, and 1060 may magnetically attach to panel 1010 via magnets embedded under the surface of panel 1010. Wireless power delivery may be used to supply power to the attached mirror chambers 110, and wireless communication with wireless radios 260 integrated within mirror chambers 110 may be used to control the illumination of connected enhanced infinity mirrors 1020, 1030, 1040, 1050, and 1060.

Panel 1010 may include a controller that detects any attached mirror chamber 110, determines the position of each attached mirror chamber 110, and synchronizes the illumination of the attached mirror chambers 110 based on the number of attached mirror chambers 110 and the detected positioning of those mirror chambers 110. More specifically, the controller of panel 710 may partition a selected pattern according to the number and positioning of mirror chambers 110 that are connected to panel 1010, and may direct the illumination of each mirror chamber 110 individually according to the pattern partitioning.

Accordingly, panel 1010 may be used to create dynamic lighting effects based on a user-defined arrangement or organization of attached mirror chambers 110 to panel 1010. Specifically, a user may arrange mirror chambers 110 in the shape of different letters, words, symbols, logos, etc. to customize the physical layout of panel 1010 as well as the lighting effects created by mirror chambers 110 attached to panel 1010.

In some embodiments, panel 1010 may support the attachment of bases 120 in addition to mirror chambers 110. The attachment of bases 120 may further alter the presentation of panel 1010, and/or may be used to simplify panel 1010 by retaining the control circuitry within the attached bases 120.

In some embodiments, enhanced infinity mirrors 100 may be dynamically organized and synchronized based on shared GPS data. For instance, each enhanced infinity mirror 100 may include, in mirror chamber 110 or in base 120, a GPS module. The GPS module may share the location of that enhanced infinity mirror 100 with other enhanced infinity mirrors 100 or with a single control device (e.g., user device 300 running application 310 or a selected primary enhanced infinity mirror 100) that is used to synchronize and/or control the illumination of multiple enhanced infinity mirrors 100.

The control device may determine the relative positioning of enhanced infinity mirrors 100 relative to one another based on the shared GPS data. The control device may partition an illumination pattern based on the relative positioning of enhanced infinity mirrors 100, and may generate a collective visual effect by configuring each enhanced infinity mirror 100 to present a different part of the partitioned illumination pattern as described above with reference to FIGS. 8 and 9.

Additionally, or alternatively, the control device may synchronize the presentation of a particular illumination across a set of enhanced infinity mirrors 100 based on the GPS data. For instance, the control device may configure a first enhanced infinity mirror chamber 110 to generate a first illumination pattern at a first time, and may configure the first enhanced infinity mirror chamber 110 to generate a second illumination pattern at a second time while configuring a neighboring second enhanced infinity mirror chamber 110 to generate the first illumination pattern at the second time. The collective visual effect may span hundreds or thousands of enhanced infinity mirrors 100 and/or mirror chambers 110, and may dynamically be adapted to changing positioning of enhanced infinity mirrors 100 and/or mirror chambers 110 as determined from updated GPS data. For instance, users may bring their enhanced infinity mirrors 100 to an event (e.g., a concert). GPS data from enhanced infinity mirrors 100 may be collected at a central controller, and the central controller may generate crowd-wide patterns based on the distribution of enhanced infinity mirrors 100 throughout the event. An example of a crowd-wide pattern may include monitoring the sound at a concert and creating a wave of light that disperses, based on the shared GPS data, through neighboring enhanced infinity mirrors 100 within the crowd or the event venue.

The GPS data may also be used to create collective visual effects when enhanced infinity mirrors 100 are attached to aerial drones. The aerial drones may position enhanced infinity mirrors 100 in three-dimensional space, a central controller may use the GPS data to determine the relative positioning of enhanced infinity mirrors 100 and to generate illumination patterns across enhanced infinity mirrors 100 based on their relative positioning. For instance, the central controller may generate an image of the American flag by having each enhanced infinity mirror 100 illuminate red, white, and/or blue based on its respective location within the collective set.

In some embodiments, enhanced infinity mirror 100 supports interchangeable mirror chambers 110 and bases 120. In some such embodiments, different shaped mirror chambers 110 may be attached to the same base 120, or different shaped bases 120 may be attached to the same mirror chamber 110. The different mirror chambers 110 may have different numbers of LEDs, and/or different physical shapes or forms that customize the appearance and/or lighting effect created by enhanced infinity mirror 100. Similarly, the different bases 120 may change the stance or exterior look of each enhanced infinity mirror 100, and/or may adapt the same mirror chamber 110 for different uses or applications. For instance, the same mirror chamber 110 may be attached to a first base for use of that mirror chamber 110 as a desktop infinity mirror, may be attached to a second base for use of that mirror chamber 110 as a novelty item such as a wand or staff, and/or may be attached to a third base for use of that mirror chamber 110 as a wearable accessory (e.g., necklace, belt buckle, etc.). In this manner, the physical or outward appearance of each enhanced infinity mirror 100 may be changed along with the illumination pattern that is generated within each mirror chamber 110.

Figure 11:
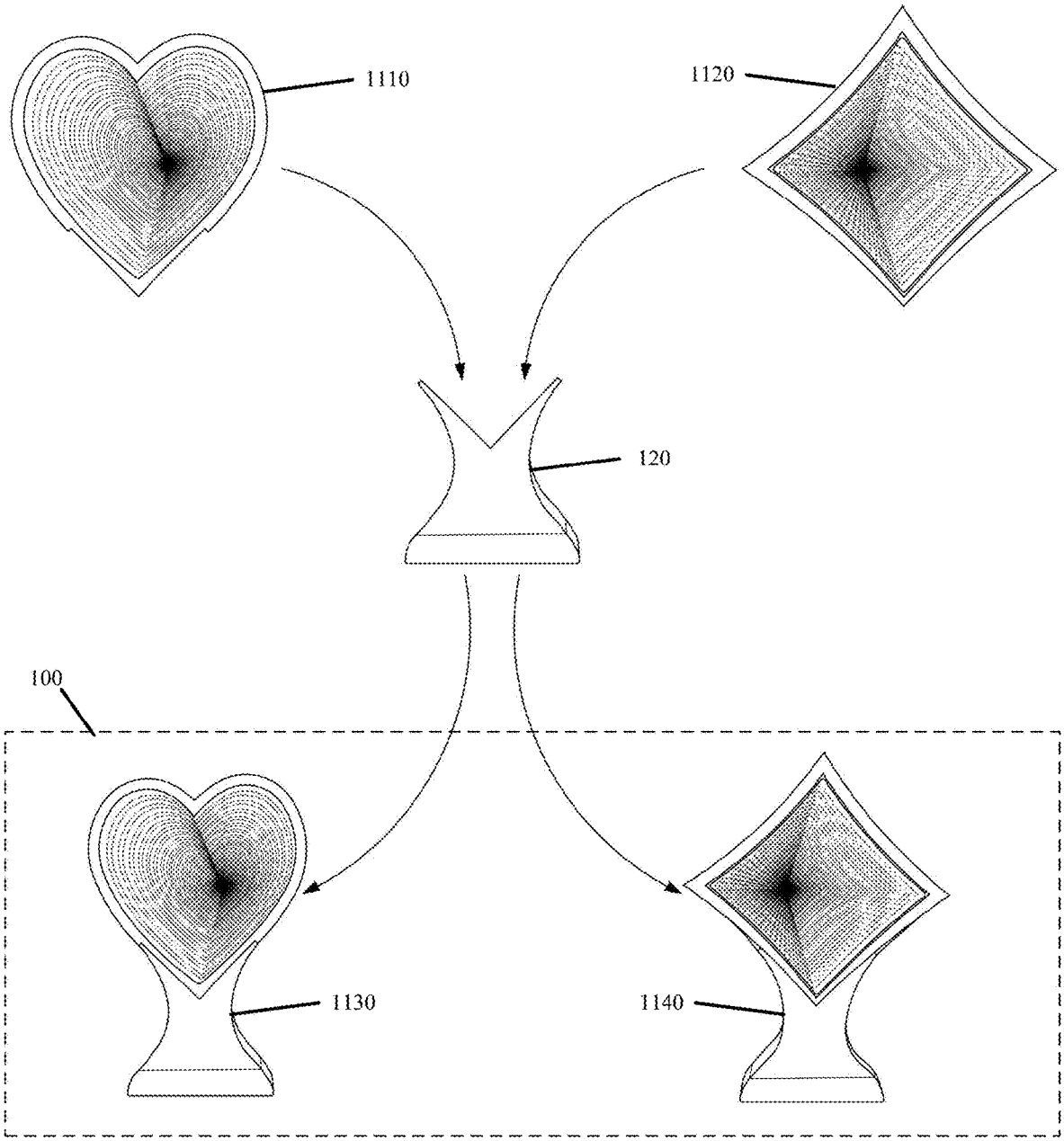
FIG. 11 illustrates an example of interchanging the mirror chamber of the enhanced infinity mirror in accordance with some embodiments presented herein.

FIG. 11 illustrates an example of interchanging mirror chamber 110 of enhanced infinity mirror 100 in accordance with some embodiments presented herein. FIG. 11 illustrates customizing the outward presentation of enhanced infinity mirror 100 by swapping different mirror chambers 1110 and 1120 onto same base 120. As shown in FIG. 11, heart-shaped first infinity mirror chamber 1110 may be connected to base 120 to form first enhanced infinity mirror 1130, and heart-shaped first infinity mirror chamber 1110 may be swapped out for diamond-shaped second infinity mirror chamber 1120 to form second enhanced infinity mirror 1140 using the same base 120.

Figure 12:
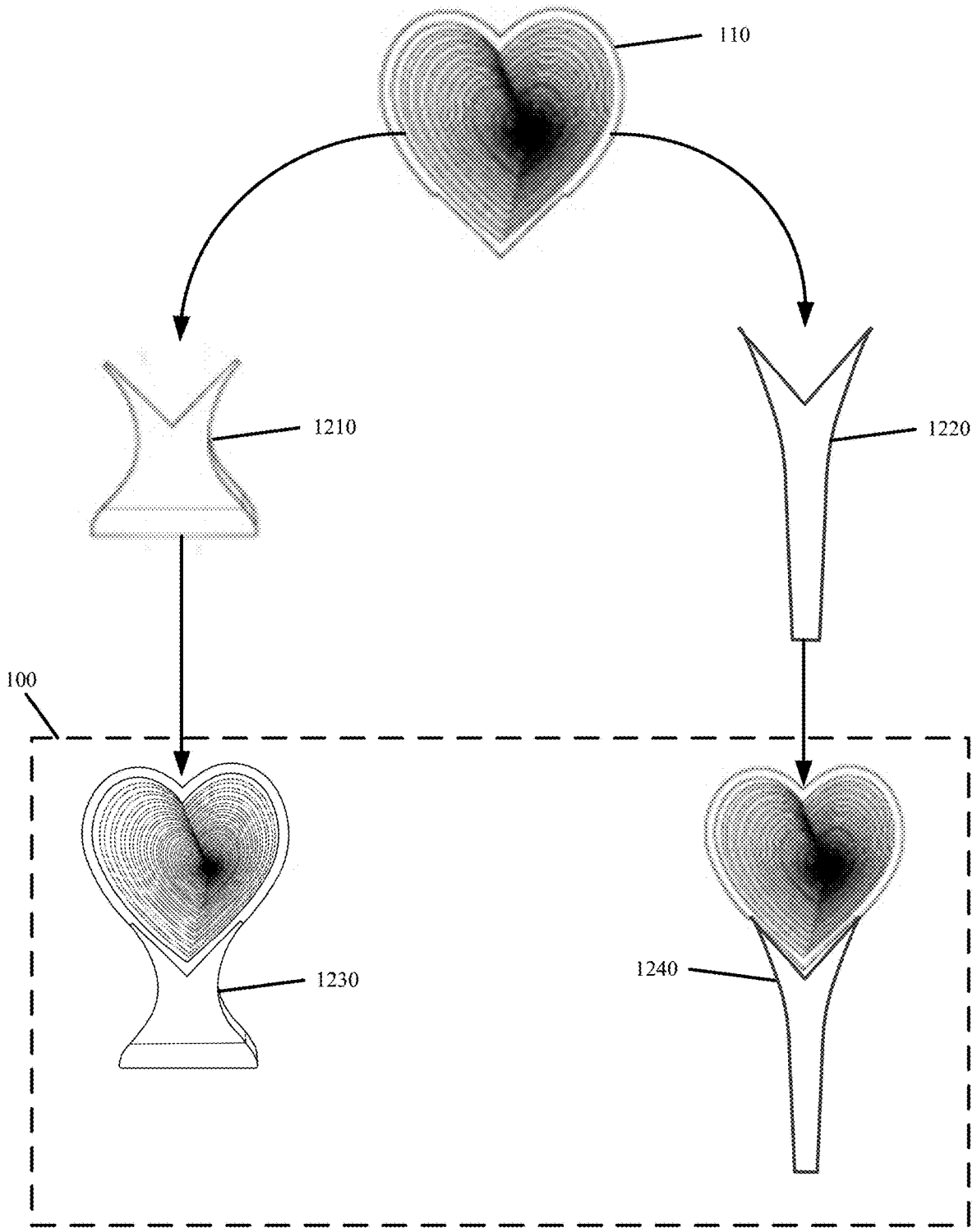
FIG. 12 illustrates an example of interchanging bases of the enhanced infinity mirror in accordance with some embodiments presented herein.

FIG. 12 illustrates an example of interchanging bases of enhanced infinity mirror 100 in accordance with some embodiments presented herein. FIG. 12 illustrates customizing the outward presentation of enhanced infinity mirror 100 by swapping different bases 1210 and 1220 onto same mirror chamber 110. As shown in FIG. 12, heart-shaped first infinity mirror chamber 110 may be connected to first table base 1210 to form first enhanced infinity mirror 1230 that may be placed atop a desk, table, or other flat surface, and first table base 1210 may be swapped out for second staff base 1220 to form second enhanced infinity mirror 1240 that may be a handheld novelty item for dance parties, events, and/or performances where the generated infinity effects enhance the environment.

Despite the different shapes and sizes of mirror chambers 110 and bases 120, the bottom section of each mirror chambers 110 may have a common form or structure to fit in and/or attach to the top section of each base 120. Accordingly, each interchangeable base 120 may have the same receiving section onto which different mirror chambers 110 may be mounted and/or attached.

The receiving section of each interchangeable base 120 may include a port or interface for communicating with and/or controlling the attached mirror chamber 110. A connection between mirror chamber 110 and interchangeable base 120 may be established when pins, prongs, and/or sockets from the port or interface of mirror chamber 110 make physical contact with the pins, prongs, and/or sockets from the port or interface about the receiving section of interchangeable base 120. In some embodiments, the port or interface may include a USB port with a male interface on one or more of mirror chamber 110 or interchangeable base 120, and with a female interface on the other one of mirror chamber 110 or interchangeable base 120. An established connection may be used to provide power from interchangeable base 120 to the connected mirror chamber 110, and/or to provide messaging that controls the illumination of mirror chamber 110.

In some embodiments, the receiving section may include a wireless port or interface for communicating with and/or controlling the mounted mirror chamber 110. For instance, rather than a physical connection being established between interchangeable base 120 and mirror chamber 110, a Near-Field Communication ("NFC"), Bluetooth, or other wireless connection may be established between interchangeable base 120 and mirror chamber 110. In some such embodiments, interchangeable base 120 may support wireless power transmission (e.g., inductive power delivery) to mirror chamber 110. For instance, interchangeable base 120 may include a power transmitting coil within the receiving section that is aligned with a receiving coil of the mounted mirror chamber 110.

In some embodiments, different bases 120 may be attached to different sides or positions about mirror chambers 110. For instance, bases 120 may be attached behind mirror chambers 110 or atop mirror chambers 110 to provide different form factors and/or embodiments of enhanced infinity mirrors 100. Different mirror chambers 110 may be connected to different bases 120 via a latching mechanism, magnetic coupling, slide-on rails, screws, contact-based mounting, temporary adhesives, heat via thermal expansion, Velcro, and/or other coupling mechanisms.

Additionally, mirror chambers 110 and bases 120 may come in different sizes to provide even more form factors for enhanced infinity mirrors. For instance, mirror chambers 110 may be reduced in size to become part of a watch face, lens for a pair goggles, central element of furniture, coaster top, lamp, wall luminaires, art installations, signage, clocks, belt buckles, phone cases, decorative ornamentation, parts of musical instruments, floor panels, wall panels, ceiling panels, headwear, electrical components (e.g., speakers) and/or components of wearable jewelry or accessories. It should be apparent to one of ordinary skill in the art that the listing of form factors provides some possible examples, and is not meant to be a complete or exhaustive enumeration of all possible form factors of mirror chambers 110 disclosed herein. In some such embodiments, physical controls 210 and/or other components of base 120 may be integrated within mirror chamber 110.

Figure 13:
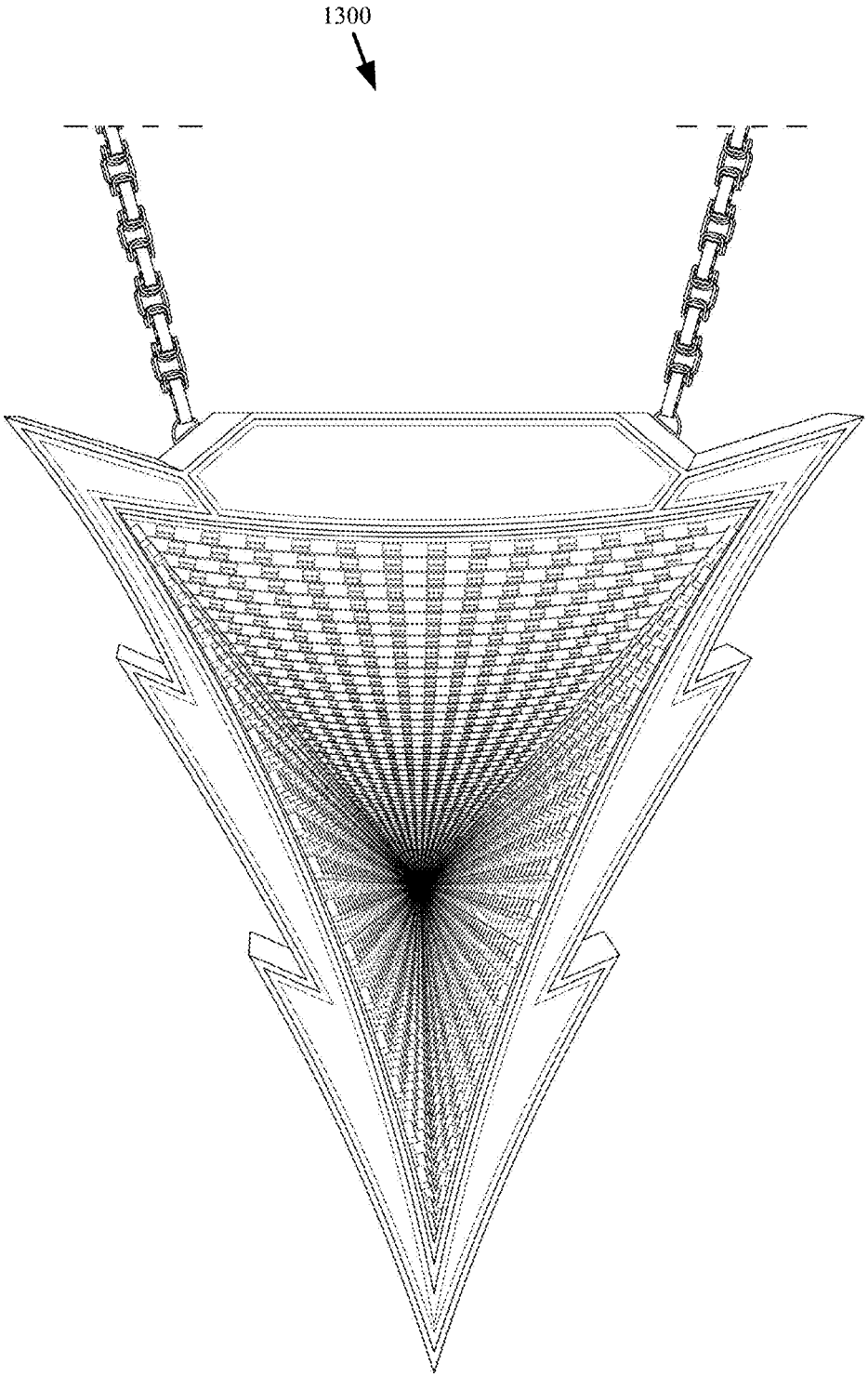
FIG. 13 illustrates an example of integrating the enhanced infinity mirror of some embodiments as part of a necklace or wearable form factor.

FIG. 13 illustrates an example of integrating enhanced infinity mirror 100 of some embodiments as part of necklace 1300 or wearable form factor. For instance, the mirror chamber may be coupled to a chain or necklace so that enhanced infinity mirror 100 may be worn around one's neck.

Figure 14:
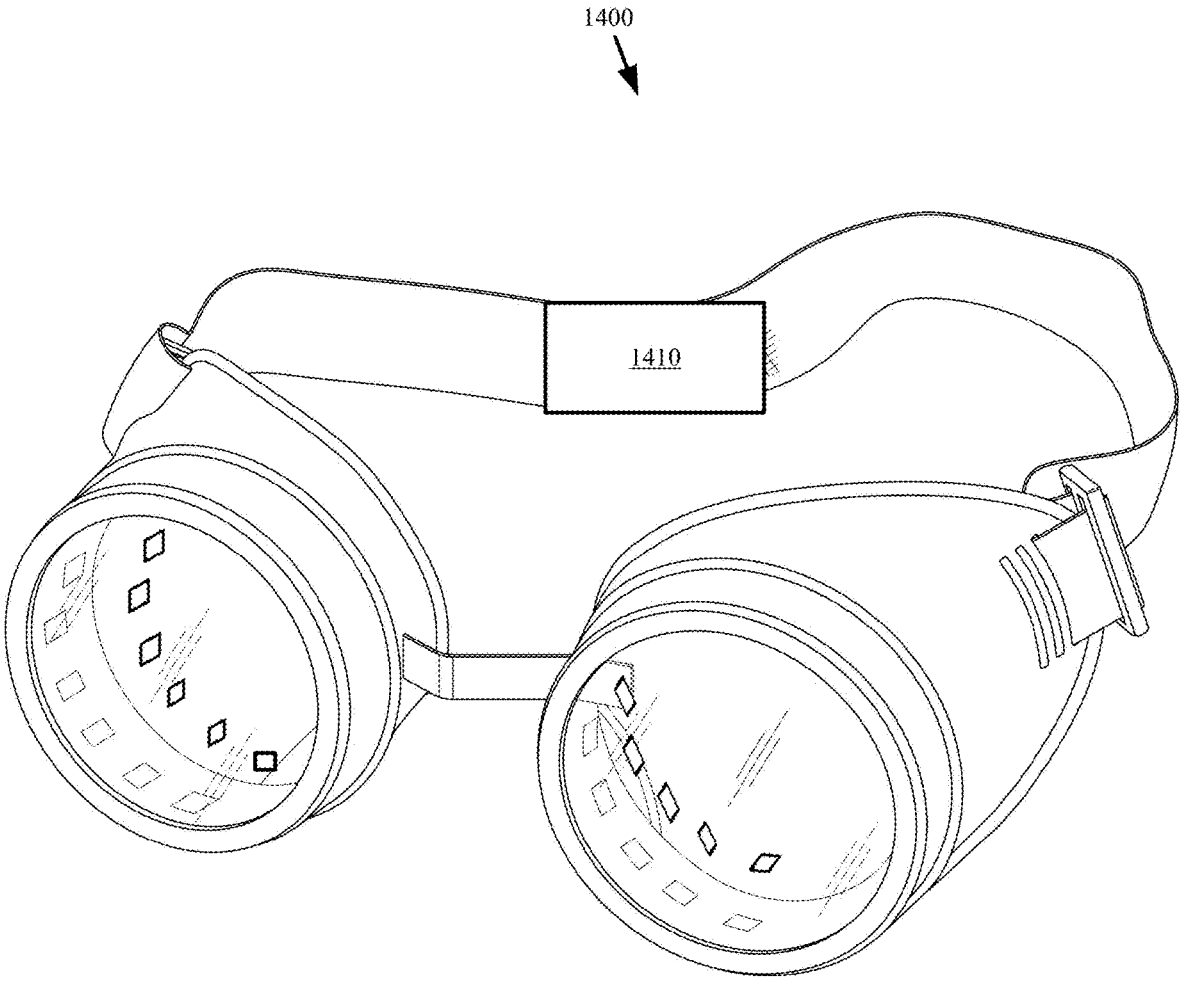
FIG. 14 illustrates an example of integrating the enhanced infinity mirror of some embodiments as part of goggles.

FIG. 14 illustrates an example of integrating enhanced infinity mirror 100 of some embodiments as part of goggles 1400. As shown in FIG. 14, each lens may include a circular infinity mirror and a central aperture for viewing through the goggles. Physical controls 210 and/or other components from base 120 may be integrated in housing 1410 affixed to the strap. A coaster may include an infinity mirror top surface under which the components and/or physical controls 210 may be housed.

Figure 15:
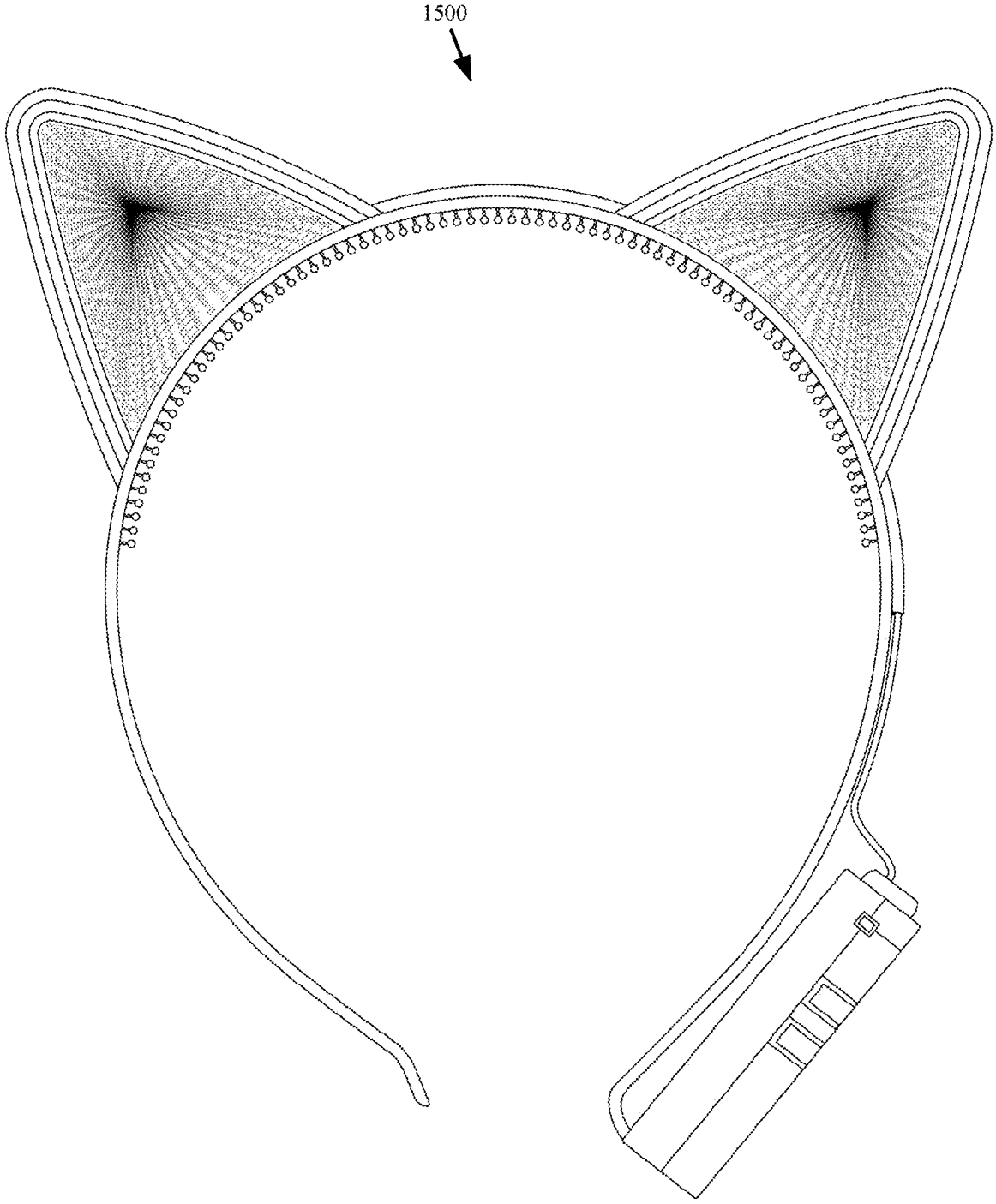
FIG. 15 illustrates an example of integrated enhanced infinity mirror 100 into headwear in accordance with some embodiments presented herein.

FIG. 15 illustrates an example of integrated enhanced infinity mirror 100 into headwear 1500 in accordance with some embodiments presented herein. Headwear 1500 may include a headband to retain the integrated enhanced infinity mirror 100 on one's head, and dual mirror chambers with a triangular shape to present the infinity mirror effects via a representation of cat ears.

In each of these and other embodiments, physical controls 210 and/or other components from base 120 may be separated from mirror chamber 110 where the lighting effects are generated. For instance, controller 230 may be housed within a first extension or compartment on one side of mirror chamber 110, and other components including power supply 250, wireless radio 260, etc. may be housed within a second extension or compartment on an opposite side of mirror chamber 110. Additionally, or alternatively, the control circuitry and/or other components may be connected to mirror chamber 110 wirelessly or with a wire, and the control circuitry and/or other components may be stored away from mirror chamber 110. For instance, the control circuitry and/or other components may be stored in a pocket, purse, hidden compartment, underside of furniture, etc.

Each of the different form factors or enhanced infinity mirror 100 embodiments may be synchronized as described above. Once again, the synchronization may be used to generate lighting effects and lighting experiences that spans multiple embodiments of enhanced infinity mirror 100.

What is claimed is:

1. A system comprising:

an enhanced infinity mirror with a mirror chamber, wherein the mirror chamber comprises:

a first reflective surface;

a second reflective surface positioned relative to the first reflective surface; and a plurality of individually controllable light sources that are positioned in front of at least one of the first reflective surface and the second reflective surface, and that generate an infinity effect through a back of the mirror chamber based on reflections off the first reflective surface and the second reflective surface; and a user device connected to the enhanced infinity mirror via a wired or wireless connection, the user device comprising one or more processors configured to:

generate a user interface ("UI");

receive a pattern comprising a plurality of steps that change illumination of the plurality of individually controllable light sources over time based on user input provided via the UI; and control illumination of different sets of the plurality of individually controllable light sources at different times according to the pattern, wherein controlling the illumination comprises controlling a first set of the plurality of individually controllable light sources to illuminate with a first set of colors for a first duration as defined in a first step of the plurality of steps, and a second set of the plurality of individually controllable light sources to illuminate with a second set of colors for a second duration as defined in a second step of the plurality of steps.

2. The system of claim 1, wherein the one or more processors are further configured to:

present, in the UI, a plurality of selectable elements in an arrangement that corresponds to an arrangement of the plurality of individually controllable light sources in the mirror chamber;

detect user input that selects a particular selectable element of the plurality of selectable elements for a particular step of the plurality of steps;

define a particular color and a particular duration with which to illuminate a particular light source of the plurality of individually controllable light sources corresponding to the particular selectable element during the particular step of the pattern based on additional user input; and wherein controlling the illumination comprises setting the particular light source to illuminate with the particular color for the particular duration at the particular step of the pattern.

3. The system of claim 1, wherein the enhanced infinity mirror is a first enhanced infinity mirror, the system further comprising:

a second enhanced infinity mirror with the mirror chamber, wherein the second enhanced infinity mirror is connected to the user device via the wired or wireless connection while the user device is connected to the first enhanced infinity mirror; and wherein the one or more processors are further configured to:

synchronize illumination of different sets of the plurality of individually controllable light sources of the second enhanced infinity mirror with the different sets of the plurality of individually controllable light sources of the first enhanced infinity mirror at the different times according the pattern.

4. The system of claim 3, wherein synchronizing the illumination comprises:

controlling a common set of the plurality of individually controllable light sources on each of the first enhanced infinity mirror and the second enhanced infinity mirror to illuminate with a same set of colors at a same time.

5. The system of claim 3, wherein synchronizing the illumination comprises:

controlling illumination of a first set of light sources on the first enhanced infinity mirror to illuminate with a first set of colors, and a second set of light sources on the second enhanced infinity mirror to illuminate with a second set of colors based on a particular step of the plurality of steps of the pattern that is defined to include at least two enhanced infinity mirrors.

6. The system of claim 1, wherein the one or more processors are further configured to:

detect a first notification for a first application running on the user device;

control illumination of a first set of the plurality of individually controllable light sources according to a first step of the plurality of steps in response to the first notification and the first step of the pattern being associated with the first notification;

detect a second notification for the first application or a different second application running on the user device; and control illumination of a different second set of the plurality of individually controllable light sources according to a second step of the plurality of steps in response to the second notification and the second step of the pattern being associated with the second notification.

7. The system of claim 1, wherein receiving the pattern comprises:

receiving a form to display with an infinity effect;

wherein controlling the illumination comprises:

analyze the form relative to a position of each light source of the plurality of individually controllable light sources in the mirror chamber; and control illumination of a particular set of the plurality of individually controllable light sources that align with a different part of the form.

8. The system of claim 1 further comprising:

a plurality of different bases that attach to the mirror chamber, wherein each base of the plurality of different bases comprises a different shape or form factor.

9. The system of claim 8, wherein the plurality of different bases comprises:

a table stand that converts the enhanced infinity mirror with the mirror chamber to a tabletop first apparatus; and a staff that converts the enhanced infinity mirror with the mirror chamber to a handheld second apparatus.

10. The system of claim 8, wherein the plurality of different bases comprises:

a first stand having a first shape that converts the enhanced infinity mirror with the mirror chamber to a tabletop apparatus; and a second stand having a different second shape that converts the enhanced infinity mirror with the mirror chamber to a wearable second apparatus.

11. The system of claim 1, wherein the enhanced infinity mirror further comprises:

a base; and a plurality of different mirror chambers that interchangeably attach to the base, each mirror chamber of the plurality of different mirror chambers comprising a different shape and a different arrangement for the plurality of individually controllable light sources.

12. The system of claim 1, wherein the user device further comprises a microphone, wherein the microphone receives an audible command comprising a pattern identifier; and wherein the one or more processors are further configured to:

select a particular pattern from a plurality of patterns that is associated with the pattern identifier; and configure the enhanced infinity mirror to illuminate according to the particular pattern.

13. The system of claim 1, wherein the enhanced infinity mirror further comprises a motion sensor; and wherein the enhanced infinity mirror dynamically adjusts the pattern in response to motion detected with the motion sensor.

14. The system of claim 1, wherein the enhanced infinity mirror further comprises a microphone; and wherein the enhanced infinity mirror dynamically adjusts the pattern in response to sound detected with the microphone.

15. The system of claim 1, wherein the enhanced infinity mirror further comprises a wireless radio; and wherein the enhanced infinity mirror dynamically adjusts the pattern in response to input provided by another enhanced infinity mirror via the wireless radio.

16. A method comprising:

providing an enhanced infinity mirror with a mirror chamber comprising a first reflective surface, a second reflective surface positioned relative to the first reflective surface, and a plurality of individually controllable light sources that are positioned in front of at least one of the first reflective surface and the second reflective surface, and that generate an infinity effect through a back of the mirror chamber based on reflections off the first reflective surface and the second reflective surface;

connecting a user device to the enhanced infinity mirror via a wired or wireless connection;

generating a user interface ("UP") on the user device;

receiving a pattern comprising a plurality of steps that change illumination of the plurality of individually controllable light sources over time based on user input provided via the UI; and controlling illumination of different sets of the plurality of individually controllable light sources at different times according to the pattern, wherein controlling the illumination comprises controlling a first set of the plurality of individually controllable light sources to illuminate with a first set of colors for a first duration as defined in a first step of the plurality of steps, and a second set of the plurality of individually controllable light sources to illuminate with a second set of colors for a second duration as defined in a second step of the plurality of steps.

17. The method of claim 16 further comprising:

presenting, in the UI, a plurality of selectable elements in an arrangement that corresponds to an arrangement of the plurality of individually controllable light sources in the mirror chamber;

detecting user input that selects a particular selectable element of the plurality of selectable elements for a particular step of the plurality of steps;

defining a particular color and a particular duration with which to illuminate a particular light source of the plurality of individually controllable light sources corresponding to the particular selectable element during the particular step of the pattern based on additional user input; and wherein controlling the illumination comprises setting the particular light source to illuminate with the particular color for the particular duration at the particular step of the pattern.

18. The method of claim 16, wherein the enhanced infinity mirror is a first enhanced infinity mirror, the method further comprising:

connecting a second enhanced infinity mirror with the mirror chamber to the user device via the wired or wireless connection while the user device is connected to the first enhanced infinity mirror; and synchronizing illumination of different sets of the plurality of individually controllable light sources of the second enhanced infinity mirror with the different sets of the plurality of individually controllable light sources of the first enhanced infinity mirror at the different times according the pattern.

19. The method of claim 18, wherein synchronizing the illumination comprises:

controlling a common set of the plurality of individually controllable light sources on each of the first enhanced infinity mirror and the second enhanced infinity mirror to illuminate with a same set of colors at a same time.

20. The method of claim 18, wherein synchronizing the illumination comprises:

controlling illumination of a first set of light sources on the first enhanced infinity mirror to illuminate with a first set of colors, and a second set of light sources on the second enhanced infinity mirror to illuminate with a second set of colors based on a particular step of the plurality of steps of the pattern that is defined to include at least two enhanced infinity mirrors.

* * * * *